US008931225B2

(12) United States Patent
Fifield et al.

(10) Patent No.: US 8,931,225 B2
(45) Date of Patent: Jan. 13, 2015

(54) BUILDING BLOCK AND CLADDING SYSTEM

(75) Inventors: John Fifield, Buckinghamshire (GB); Leonard Browning, Aurora, IL (US)

(73) Assignee: Oldcastle APG, Inc., Atlanta, GA (US)

( * ) Notice: Subject to any disclaimer, the term of this patent is extended or adjusted under 35 U.S.C. 154(b) by 161 days.

(21) Appl. No.: 13/321,671

(22) PCT Filed: May 21, 2010

(86) PCT No.: PCT/US2010/035739

§ 371 (c)(1),
(2), (4) Date: Feb. 22, 2012

(87) PCT Pub. No.: WO2010/135626

PCT Pub. Date: Nov. 25, 2010

(65) Prior Publication Data

US 2012/0266554 A1 Oct. 25, 2012

Related U.S. Application Data

(60) Provisional application No. 61/180,533, filed on May 22, 2009.

(30) Foreign Application Priority Data

Dec. 17, 2009 (GB) ..... 0922112.8

(51) Int. Cl.
*E04B 1/70* (2006.01)
*E04F 13/08* (2006.01)

(52) U.S. Cl.
CPC ..... *E04F 13/0803* (2013.01); *E04F 13/0826* (2013.01); *E04F 2201/035* (2013.01)
USPC ..... 52/302.1; 52/309.4; 52/582.1; 52/546; 52/547

(58) Field of Classification Search
USPC ..... 52/302.1, 309.1, 309.4, 309.12, 582.1, 52/588.1, 520, 533, 543, 546, 547, 539, 52/586.1, 478, 592.5
See application file for complete search history.

(56) References Cited

U.S. PATENT DOCUMENTS

| | | | | |
|---|---|---|---|---|
| 5,029,425 | A | 7/1991 | Bogataj | |
| 5,502,940 | A * | 4/1996 | Fifield | 52/309.12 |
| 5,860,257 | A | 1/1999 | Gerhaher et al. | |
| 2003/0145553 | A1 | 8/2003 | Schiedegger et al. | |
| 2006/0272261 | A1 * | 12/2006 | Ito | 52/586.1 |

FOREIGN PATENT DOCUMENTS

| | | | |
|---|---|---|---|
| EP | 0225788 | A2 | 6/1987 |
| WO | 2007-062525 | A1 | 6/2007 |

OTHER PUBLICATIONS

International Preliminary Report on Patentability and Written Opinion of the ISA as it related to Appln. No. PCT/US2010/035739 mailed Dec. 1, 2011.

* cited by examiner

*Primary Examiner* — Charles A Fox
*Assistant Examiner* — Patrick Maestri
(74) *Attorney, Agent, or Firm* — Kilpatrick Townsend & Stockton LLP

(57) ABSTRACT

A cladding system for cladding a supporting wall is disclosed. The cladding system includes a plurality of building blocks, each having a body and a facing; and a plurality of support brackets for mounting the blocks on the supporting wall in a plurality of adjoining horizontal rows. The body of each block includes engagement means for engaging at least one of the support brackets such that, in use, at least a part of the body of each block abuts at least a part of the body of a neighbouring block in an adjoining row so as to guard against water penetration between the rows.

9 Claims, 33 Drawing Sheets

BUILDING BLOCK AND CLADDING SYSTEM

CROSS-REFERENCE TO RELATED APPLICATIONS

This application is a U.S. national phase entry of International Application No. PCT/US2010/035739, filed May 21, 2010, which claims the benefit of British Application No. GB 0922112.8, filed Dec. 17, 2009, and which claims benefit of U.S. Provisional Application Serial No. 61/180,533, filed May 29, 2009.

The present invention relates to a building block. In particular, but not exclusively, the present invention relates to a building block that is suitable for cladding a wall and a corresponding cladding system, as well as to a method for manufacturing a building block and a method for cladding a wall.

Cladding of walls is a well-known technique used in the construction industry wherever it is desirable to cover an inner wall with a skin or layer for decorative or functional reasons.

For example, to minimise construction costs, it is often desirable to construct an inner wall of a building from a relatively inexpensive material such as breeze blocks or cinder blocks. Such materials provide good structural support to the building but are often aesthetically unattractive. The inner wall may be vulnerable to weather damage or water ingress, for example if the material of the inner wall is porous or susceptible to damp.

In such circumstances, a cladding system can be used to cover the inner wall. Typically, such cladding systems comprise a plurality of brackets or rails that are affixed to the inner wall. Sheets or panels of a lightweight cladding material are attached to the rails, so as to create an outer skin that covers the inner wall. The cladding material can be attractive in appearance and can be resistant to water. Cladding materials currently in use include ceramic tiles, reconstituted stone boards, laminates, aluminium and fibre-cement board.

In some cladding systems, known as rainscreen cladding systems, the outer skin is arranged so that a cavity exists behind the cladding material. In such a case, the panels of cladding material deflect most of the water and wind striking the wall in bad weather. Water that penetrates the outer skin, through the joints between the panels, enters the cavity and either drains away down the back face of the cladding or evaporates from the cavity. Any condensation that forms in the cavity is discharged in the same manner. In this way, the inner wall remains substantially dry, even though the outer skin may not itself be entirely watertight.

Cladding systems often incorporate one or more layers of thermally-insulating material between the cladding material and the inner wall. The thermally-insulating material serves to increase the thermal resistance, or R-value, of the clad wall, thus reducing heat loss from the building through the wall.

In addition to their use in the construction of new buildings, cladding systems can also be used to provide an outer skin over the walls of an existing building, for example to rejuvenate or change the appearance of the building, to improve its thermal insulation and weather resistance, and/or to protect the original building from weather damage.

Existing cladding systems tend to be relatively complex, expensive and difficult to install. For instance, the brackets or rails must be adjustable to allow the panels to be properly aligned. The thermally-insulating material is usually added in a separate step, increasing the assembly time required.

Furthermore, it is normally desirable to connect the cladding panels to the brackets in such a way that no part of the connection is visible from the outside of the building. Such 'secret fixing' can make a cladding system even more complex to install and can mean that replacement of a single panel during maintenance work can require the removal and replacement of several adjacent panels.

Due to the complexity of existing cladding systems, the weather resistance and thermal insulation properties of the systems are often compromised.

Against this background, it would be desirable to provide a cladding system which is simple to construct and inexpensive to produce whilst also providing improved weather resistance and thermal insulation, and a building block suitable for use in such a cladding system.

Accordingly, in a first aspect, the present invention provides a cladding system for cladding a supporting wall, the cladding system including a plurality of building blocks, each having a body and a facing; and a plurality of support brackets for mounting the blocks on the supporting wall in a plurality of adjoining horizontal rows. The body of each block includes engagement means for engaging at least one of the support brackets such that, in use, at least a part of the body of each block abuts at least a part of the body of a neighbouring block in an adjoining row so as to guard against water penetration between the rows.

Because the bodies of blocks in adjoining horizontal rows abut one another, at least in part, the bodies of the blocks in the cladding system of the present invention provide a substantially continuous thermally insulating and water-proof barrier between the facings and the supporting wall. Unlike existing rainscreen cladding systems which typically have gaps between the cladding elements, in the present invention the cladding system is substantially waterproof.

In one embodiment of the invention, in use, the weight of the blocks is supported by the supporting wall without the facings of adjacent blocks being in load-transferring contact. Because no significant load is transferred through the facings of the blocks in this arrangement, the facings of the blocks need not be designed to support the weight of the facings of other blocks. Consequently, the facings of the blocks can be significantly lighter than would otherwise be the case. Additionally, the support brackets need be designed only to support the weight of relatively few blocks. Thus the cladding system can be relatively low-cost and simple to make and install.

Optionally, to ensure that the facings of adjacent blocks are not in load-transferring contact, the facing of each block may be slightly smaller in area than a front face of the body of the block on which the facing is mounted.

Conveniently, the engagement means comprises bracket-receiving recesses in top and bottom faces of the body of each block for receiving respective upwardly-projecting and downwardly-projecting elements of the support bracket which project from a base member of the support bracket.

The engagement means may further comprise at least one cutaway in the body adjacent to at least one of the bracket-receiving recesses for receiving the base member of the support bracket. The or each cutaway may extend across a portion of the respective top or bottom face of the body, such that a remaining portion of the face can abut at least a part of a block in an adjacent row. In this way, the support brackets can be accommodated between blocks in adjacent rows without interrupting the body-to-body contact of the blocks.

In one embodiment, the base member of the support bracket is received in part in a cutaway in the top face of the body of a block, and in part in a cutaway in the bottom face of the body of a neighbouring block in an adjoining row. In this embodiment, the top and bottom faces of the block bodies can be identical so that the block can be installed either way up.

The support bracket and the blocks are preferably dimensioned such that, in use, a cavity is provided between the wall and the blocks. Such a cavity advantageously improves the insulating properties of the cladding system, and also provides an air gap into which any water that penetrates between the blocks can pass, whereupon the water can evaporate or drain away.

In one embodiment, the facing of each block is of a first material, and the body of each block is of a second material, the second material having a lower density than the first material. The body of each block is preferably of a lightweight material, which is optionally thermally insulating also. In this way, the blocks are easier and safer to handle manually than would otherwise be the case. The body may for example be of expanded polystyrene. The facing of each block may be a cementitious material.

In use, at least a part of the body of each block may abut at least a part of the body of a neighbouring block in the same row, so as to guard against water penetration between the blocks within a row. Accordingly, in this arrangement, the body of each block abuts its neighbours on all four sides, so as to form a substantially continuous thermally insulating layer parallel to the supporting wall. The layer is also substantially waterproof.

In one embodiment, the facing of each block includes an overhanging portion that extends beyond the body of the block, such that, in use, the overhanging portion of the facing overlaps the facing of a neighbouring block in an adjoining row. Preferably, the overhanging portion of the facing extends beyond a bottom surface of the body and, in use, overlaps a top portion of the facing of a neighbouring block in the row below. In such an arrangement, the cladding system gives the appearance of, for example, wood shake siding.

In a second aspect, the present invention provides a body for a building block, the body being shaped to engage with the material of a facing in such a manner as to guard against relative movement of the facing with respect to the body in any direction.

By virtue of the shape of the body, the facing of a building block which includes such a body is resistant to slip or creep with respect to the body. For example, the facing is unlikely to slide downwards under the force of gravity when the building block is installed with the facing in a vertical orientation, such as in a wall. Similarly, the facing is resistant to lateral movement, and to being pulled away from the body. Thus such a building block is mechanically stable, and is suitable for use in a cladding system.

Furthermore, since the body can hold a facing in a particularly secure engagement with the body, a building block consisting of such a body with a facing attached thereto can be transported, handled and used as though it were a unitary component, even when the material of the body is different from the material of the facing.

The body and the facing materials can be different types of materials, and the materials used can be chosen so as to optimise the performance of a building block including the body of the second aspect of the invention. For example, because the body is shaped to engage with a facing material, the appearance and weather-resistance of the material of the body may not be important, since those properties can be bestowed on a building block by appropriate selection of a facing material.

In a particularly advantageous embodiment of the invention, the body is of a lightweight, thermally-insulating material, such as expanded polystyrene. The use of such a material gives the body a high thermal resistance or R-value, making it suitable for use in many applications where thermal insulation is important. Furthermore, since the material is lightweight, building blocks including such bodies can be made light enough for repeated handling by an individual, whilst being of a reasonable size to allow rapid construction using the blocks.

The engagement of the body with the facing preferably incorporates engagement surfaces of the body which engage with complementary engagement surfaces of the facing. In this way, the engagement surfaces of the body provide a secure and movement-free engagement with the facing.

It is particularly advantageous if the engagement surfaces of the body are oriented with respect to a front face of the body in such a manner as to form an interlock with the engagement surfaces of the facing in order to guard against relative movement of the facing with respect to the body in three mutually perpendicular directions.

In this case, an interlock between the body and the facing material arises by virtue of the orientation of the engagement surfaces of the body. Because the effect of the interlock is to guard against relative movement of the facing with respect to the body in three mutually perpendicular directions, movement of the facing with respect to the body in any direction is substantially prevented in normal use.

In one embodiment, the engagement surfaces of the body define walls of a recess in the front face of the body. Preferably, at least one of the side walls is inclined to define an undercut region of the recess. Advantageously, when the engagement surfaces of the projection engage with the undercut region, movement of the facing with respect to the body in a direction normal to the front face of the body can be guarded against. Thus the undercut region helps to stop the facing being displaced outwardly from the body.

The recess may incorporate two opposing side walls which diverge in a direction away from the front face of the body. The recess may, for example, incorporate a dovetail mortise. The opposing side walls help to stop the facing being displaced laterally with respect to the body.

The recess may extend linearly across a part of, or the whole of, the front face of the body. Said another way, the recess may extend linearly across the front face of the body from one edge of the front face to another, preferably opposite, edge of the front face, or the recesses may stop short of the edges of the front face. In one example, the recesses extend between opposite edges of the front face of the body across the shortest dimension of the front face. In one method of manufacturing of a building block incorporating a body according to the second aspect of the invention, in which a facing material is cast onto the front face of the body, the provision of such linearly-extending recesses in the body helps to ensure that the facing material fills the recesses.

The recess may incorporate one or more arcuate wall portions. For example, in one embodiment, the recess incorporates at least two oppositely-facing arcuate wall portions.

Preferably, the recess incorporates a linear portion which extends in a first direction, and wherein the or each arcuate wall portion curves outwardly from the linear portion in a second, perpendicular direction. In a building block incorporating such a body, the linear portion of the recess helps to guard against displacement of the facing with respect to the body in a first direction lying parallel to the front face of the body, while the arcuate wall portions help to guard against displacement of the facing with respect to the body in a second direction lying parallel to the front face of the body and being perpendicular to the first direction.

Preferably, there is a plurality of recesses, each recess being of one of the types described above. All of the recesses of the plurality may be of the same shape, or a plurality of different shapes of recess may be provided. When a plurality of recesses are provided, the engagement surfaces can be spread over a greater area of the body, and therefore the body can engage a facing more securely, than if only one recess were provided.

The body may conveniently be capable of acting as a mould for the facing. In this case, the shape of the body serves as a mould frame or template for the shape of the facing, such that the facing is complementary in shape to the body. In this way, the facing can be permanently attached to the body to form a building block in a straightforward manufacturing process.

The body may incorporate a plurality of drainage channels in a rear face of the body. For example, a plurality of drainage channels may be provided which are arranged to extend downwardly in use. The body may include one or more inclined channels or slots in the top face of the body for directing water towards the rear face of the body. The inclined channels may define a gutter in a top face of the body to direct water into the drainage channels, when present, in use. When a plurality of building blocks incorporating such bodies are assembled together to form a wall-like structure, such drainage channels, and gutters if present, advantageously allow any water that penetrates the structure to drain down the rear surface of the bodies. This is particularly useful when the structure is a cladding for an internal wall, since by these means the penetrating water is directed away from the internal wall.

In a third aspect, the invention extends to a building block having a body according to the second aspect of the invention, and a facing which engages with the body in such a manner as to guard against relative movement of the facing with respect to the body in any direction.

In a particularly preferred embodiment of the third aspect of the invention, the facing is of a cementitious material. For example, the facing could be formed from a cement, sand and water mixture, a concrete mixture comprising cement, sand, aggregate and water, or a reconstituted stone material. A facing of cementitious material can be relatively low-cost, and offers a high degree of resistance to environmental factors such as water, pollution, wind erosion and so on. Furthermore, such a facing can readily be given an attractive appearance. For example, the facing could be moulded so as to have a textured or patterned face to mimic a natural material such as stone or wood, or could be polished, glazed or otherwise finished. Similarly, the material of the facing could be coloured or dyed or, since many cementitious materials accept paint readily, the facing could be painted or otherwise coated.

The facing preferably includes engagement surfaces which interlock with engagement surfaces of the body. The engagement surfaces of the facing may, for example, define a projection which extends from a rear face of the facing and interlocks with a corresponding recess in a front face of the body. The projection optionally incorporates a dovetail tenon, which conveniently interlocks with a dovetail mitre in the front face of the body. Alternatively, or in addition, the projection may incorporate one or more arcuate wall portions which interlock with one or more corresponding arcuate wall portions of a recess in a front face of the body. Advantageously, the facing and the projection are integral. For example, when the facing material is cast onto a front face of the body during manufacture of the block, the projection may be formed by filling a corresponding recess in the front face of the body with the facing material.

Vertical and/or horizontal grooves may be provided in the facing to give the visual impression that each block includes a plurality of smaller blocks. In one embodiment, in which the facing includes projections for engagement with recesses in the body, vertical grooves are provided in the facing at irregular intervals across the width direction of the facing, to mimic the appearance of natural elements having a plurality of different widths. Advantageously, each vertical groove in the front face of the facing coincides with the position of a projection on the rear face of the facing. In this way, each groove is located where the thickness of the facing is at its greatest, so as to guard against the risk of mechanical failure.

In a fourth aspect of the invention, a method of manufacturing a building block having a body and a facing is provided. The method includes casting a settable facing material onto the body of the to form the facing which engages with the body during casting in such a manner as to guard against relative movement of the facing with respect to the body in any direction when the facing material has set.

By virtue of this method, a building block having a body which is securely engaged with a facing can be easily and conveniently manufactured using a pre-formed body. It is not necessary to pre-form a separate facing, since the facing of the block is both shaped and attached to the body in the same operation.

To this end, engagement surfaces on the facing may be formed during casting of the facing to interlock with engagement surfaces of the body.

Preferably, the settable facing material is a cementitious material. Alternatively, the settable facing material may be a curable resin, a melt or a similar material. The facing material may be pourable or, as for example in the case of a relatively dry cementitious mix, the facing material may be non-pourable.

The method of the fourth aspect of the invention can be used to manufacture a building block according to the third aspect of the invention.

In a fifth aspect of the invention, a body for a building block is provided which has a first groove in a face thereof and a second groove in an opposite face thereof arranged so that, when a plurality of such blocks are assembled together to form a wall, the first groove cooperates with the second groove of a neighbouring block to define a cavity for a deformable sealing material, wherein the first groove includes a ridge which projects inwardly into the cavity to facilitate deformation of the sealing material within the grooves when the blocks are assembled together with the sealing material therebetween.

In this way, when the blocks are assembled together, the ridge helps the sealing material to form a seal between the blocks by pressing the sealing material against the walls of the grooves. The seal is particularly useful in guarding against the penetration of air through the assembly between neighbouring blocks.

To facilitate deformation of the sealing material, the first groove may be 'W'-shaped in cross-section, the ridge being the peak of the 'W'. Similarly, the second groove may be V'-shaped or 'U'-shaped in cross-section. The grooves may for example be provided in oppositely-disposed top and bottom faces of the body, or in oppositely-disposed side faces of the body, although in a preferred embodiment the grooves are provided in oppositely-disposed top and bottom faces of the body and in oppositely-disposed side faces of the body. In that case, each groove may extend over a respective corner of the body.

The body of the fifth aspect of the invention may incorporate features of the first to third aspects of the invention also. A building block incorporating the body of the fifth aspect of the invention may be manufactured by the method of the fourth aspect of the invention.

In a sixth aspect of the present invention, a body for a building block for use in the cladding system of the first aspect of the invention is provided, in which top and bottom faces of the body include bracket-receiving recesses for receiving respective upwardly-projecting and downwardly-projecting elements of the support brackets which project from a base member of each support bracket. By virtue of this arrangement, building blocks incorporating such bodies are self-aligning when they are mounted on the support brackets.

The bracket-receiving recesses are advantageously in the form of channels extending across the width of the body to allow the block to slide laterally on the support brackets when mounting the building blocks on the supporting wall. Thus, during assembly of the cladding system, the blocks can be slid along the support brackets.

The body preferably comprises at least one cutaway in the body adjacent to at least one bracket-receiving recess to accept the base member of the support bracket. By virtue of the cutaway, the bodies of adjacent blocks can be placed into abutting contact during assembly of the blocks in a cladding system, which helps to prevent wind-driven water and air from passing between the blocks.

As in other aspects of the invention, the body may comprise a plurality of drainage channels in a rear face of the body, and optionally a gutter in the top face of the body to direct water into the drainage channels, in use.

The body may include a removable portion of the body arranged to support an overhanging portion of a facing during manufacture of a building block using the body.

The body of the sixth aspect of the invention may also include features of, or be in accordance with, the second and/or the fifth aspect of the invention. Alternatively, or in addition, the body of the sixth aspect of the invention may be incorporated in a building block having features of, or being in accordance with, the building block of the third aspect of the invention.

In a seventh aspect, the present invention extends to a support bracket for use in the cladding system of the first aspect of the invention. The support bracket comprises mounting means for mounting the bracket on the supporting wall; and support means to engage with the blocks.

The mounting means may comprise an upstanding member of the bracket, which may for example include holes through which fasteners such as nails or screws can be inserted. In this way, the support bracket can easily be mounted to a supporting wall.

The support means of the support bracket preferably comprises a plurality of upwardly-projecting and downwardly-projecting elements which project from a base member of the support bracket. This arrangement aids alignment of the blocks of the cladding system, since the upwardly-projecting elements engage with a first block on one side of the support bracket while the downwardly-projecting elements engage with a second block on the other side of the support bracket. The first and second blocks are thereby aligned with one another. The upwardly-projecting elements may be interdigitated with the downwardly-projecting elements.

The support bracket may include drainage means for allowing fluid such as air or water to pass through the support bracket. Thus, when the support bracket is installed in a cavity, the drainage means allow water to drain within the cavity. Furthermore, the drainage means allows air to move within the cavity, which aids evaporative dispersion of water from the cavity. The drainage means may, for example, include holes or slits.

In an eighth aspect of the present invention, a method of cladding a supporting wall is provided. The method includes mounting a support bracket to the wall, placing a first building block on the support bracket, placing a second building block on the support bracket, and sliding the second block into abutment with the first block. This method is a particularly straightforward way of assembling blocks to clad a wall, since it avoids the need to use fasteners, clips and so on, and allows neighbouring blocks to be easily abutted and aligned.

The method preferably includes forming a seal between the first and second blocks. For example, the method may include placing a sealing material between the first and second blocks before sliding the second block into abutment with the first block so as to form a seal between the blocks.

The method may also extend to cladding a corner between first and second adjacent supporting walls, in which case the method includes mounting a support bracket to each wall, removing a portion of the body of the first building block to leave an overhanging portion of the facing, placing the first block on the support bracket mounted to the first wall, so that the overhanging portion of the facing projects beyond the corner, placing the second block on the support bracket mounted to the second wall, and sliding the second block into abutment with the first block, so that a side face of the body of the second block abuts a rear face of the overhanging portion of the facing of the first block. It will be appreciated that the order in which the blocks are placed on the wall is interchangeable.

Since this expression of the method includes removing a portion of the body of a building block, blocks that are specially designed for fitment at corners, sometimes known in the art as 'specials', need not be provided. Instead, the building blocks provided can all be identical in form and, when a corner is encountered when performing the method, blocks can be modified as appropriate by removing the necessary portion of the body of each block. Accordingly, it is preferred that the body of each block is of a cuttable material, such as expanded polystyrene referred to previously.

The method of the eighth aspect of the invention is preferably used for cladding a wall with the cladding system of the first aspect of the invention.

Preferred embodiments of the present invention will now be described, by way of example only, with reference to the accompanying drawings in which.

Figure 1:
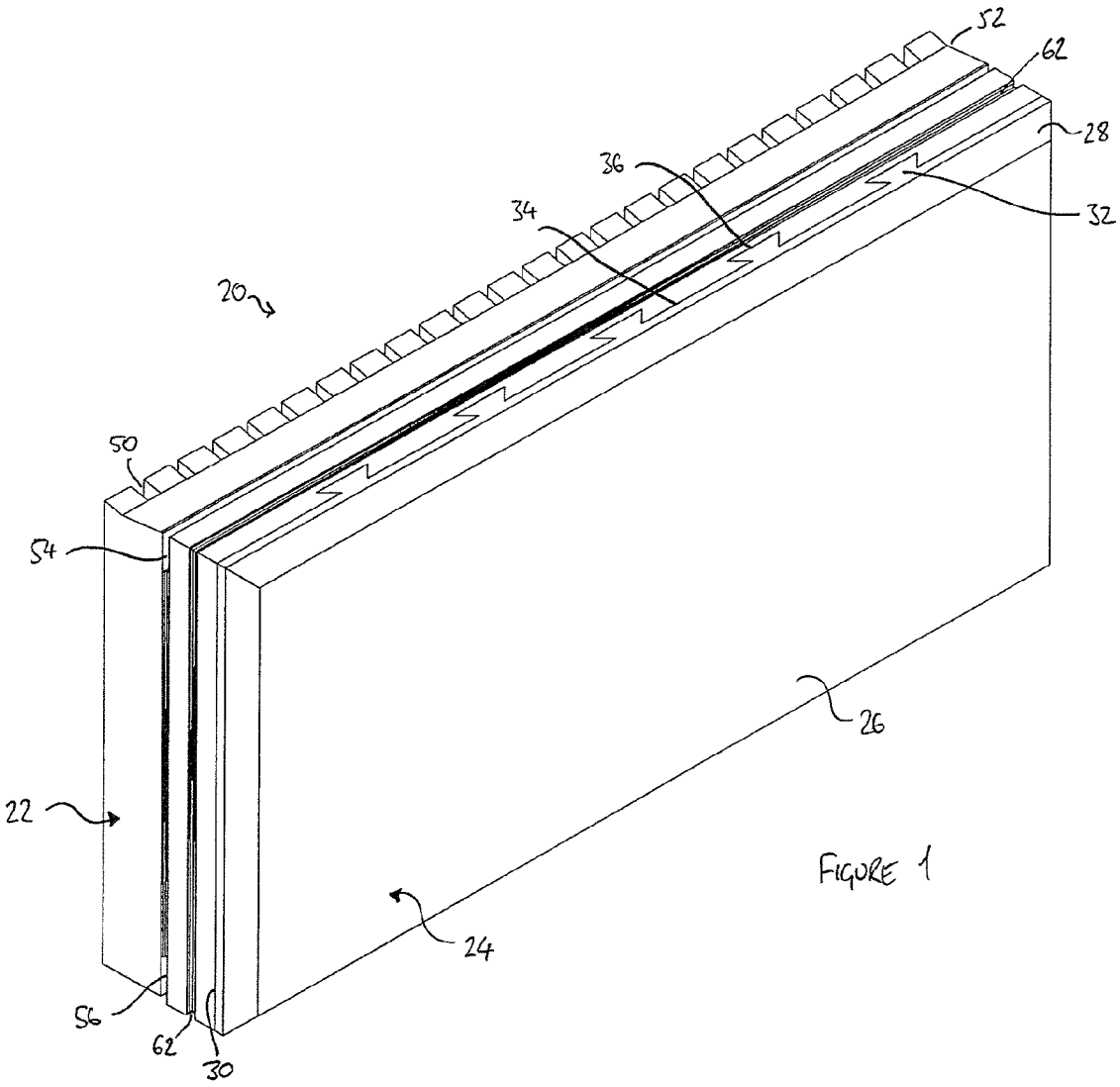
FIG. 1 is a perspective view, from the front, of a building block according to one embodiment of the present invention.

Throughout this specification, terms such as "top" and "bottom", "upper", "lower" and "side", "front" and "rear", "horizontal" and "vertical" are used with reference to the orientation of the building blocks as they would be placed during normal use in a walling application, as shown in for example FIG. 1, although it will be appreciated that the blocks could be used in different orientations.

FIGS. 1 to 4 show a building block 20 according to the present invention. The building block 20 comprises a body 22 and a facing 24 attached thereto. The facing 24 is made from a cementitious material formed from a mixture of cement, sand and water, and optionally aggregate, and the body 22 is made from a low-density, thermally insulating material such as expanded polystyrene.

Figure 5:
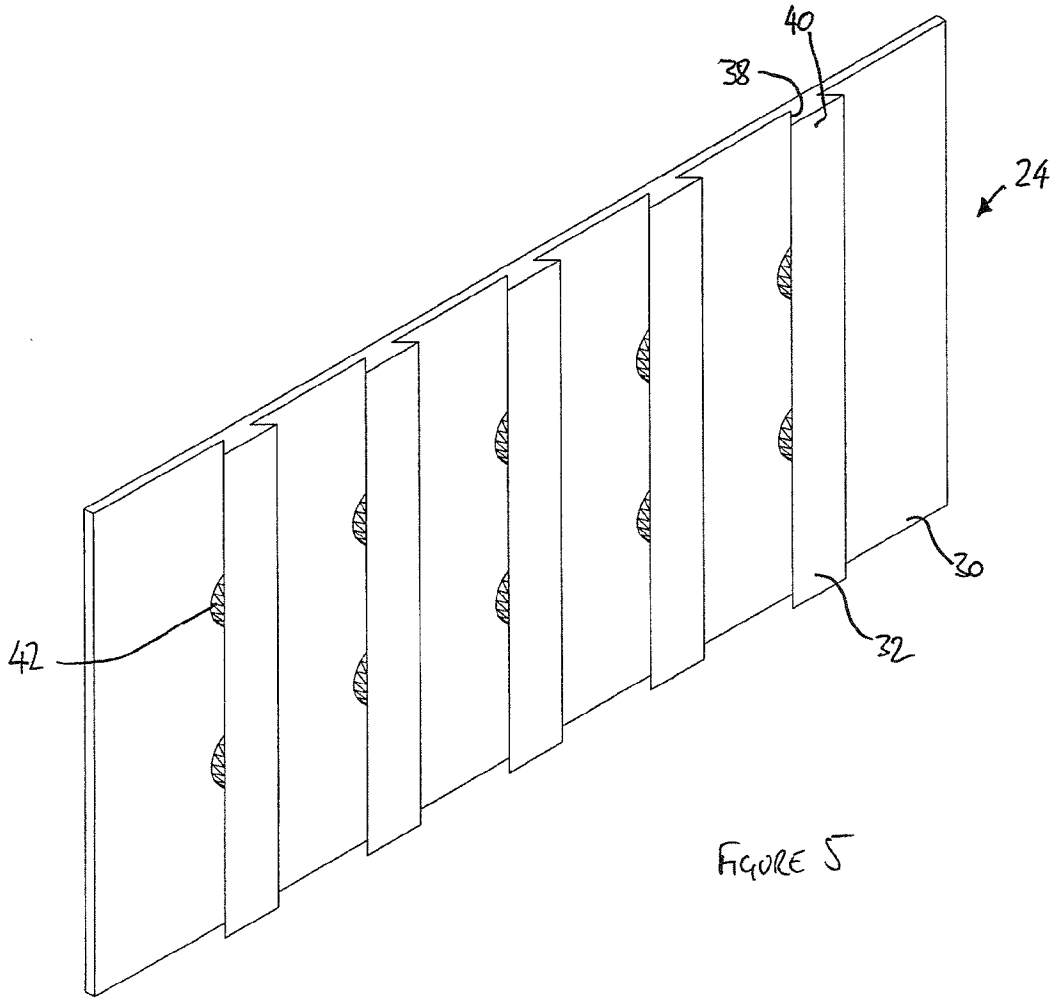
FIG. 5 is a perspective view, from the rear, of the facing of the building block of FIG. 1, in isolation from the body of the building block.

The facing 24 has a front face 26 surrounded by a chamfered edge 28 and a rear face 30, which is innermost when the facing 24 is attached to the body 22. FIG. 5 shows the facing 24 in isolation from the body 22, so that the rear face 30 of the facing can be seen in detail. Several projections 32 extend rearwardly from the rear face 30 of the facing 24.

Figure 6:
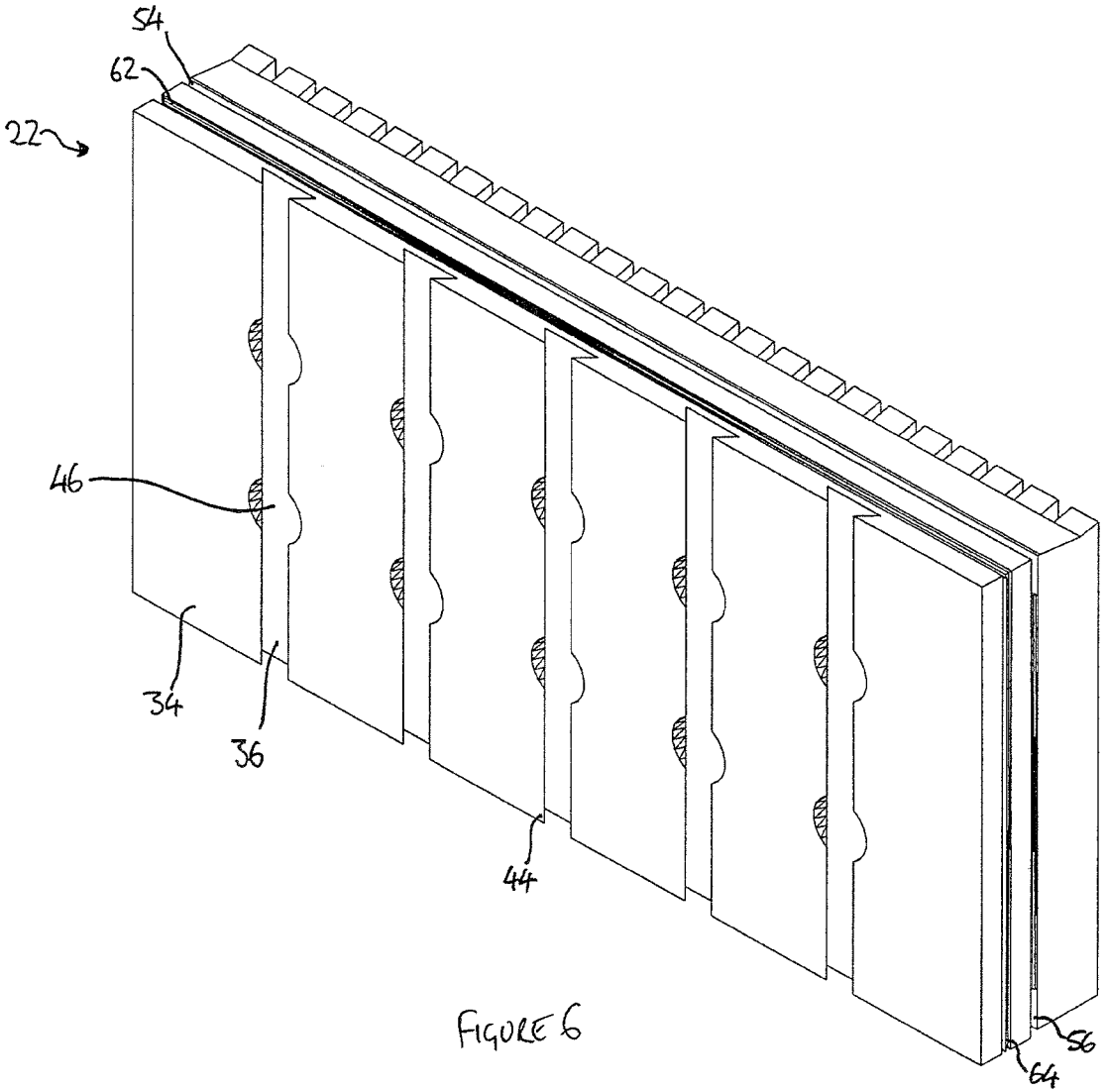
FIG. 6 is a perspective view, from the front, of the body of the building block of FIG. 1, in isolation from the facing of the building block.

The facing 24 abuts a front face 34 of the body 22, so that the front face 34 of the body 22 is innermost when the facing 24 is attached to the body 22. FIG. 6 shows the body 22 in isolation from the facing 24, so that the front face 34 of the body 22 can be seen in detail. The front face 34 is provided with several recesses 36, which interlock with the projections 32 of the facing 24.

As shown most clearly in FIG. 5, each projection 32 extends vertically from the top to the bottom of the facing 24. As shown additionally in FIG. 7, each projection 32 includes inclined side walls 38 which diverge outwardly to meet the rearmost surface 40 of each projection 32. The side walls 38 on opposing sides of the projection 32 therefore undercut the rearmost surface 40 of the projection, so as to form a dovetail tenon.

At two positions along each projection 32, at approximately one-third and two-thirds of the height of the facing 24, the side walls 38 on opposite sides of each projection 32 include arcuate portions 42. Each pair of arcuate portions 42 can be considered to define a cylinder having an axis extending normal to the rear face 30 of the facing 24. Thus each projection 32 has the shape of a bar with a trapezoidal cross section, extending linearly from the top to the bottom of the facing 24, superimposed on the two cylinders defined by the arcuate wall portions 42.

Figure 7:
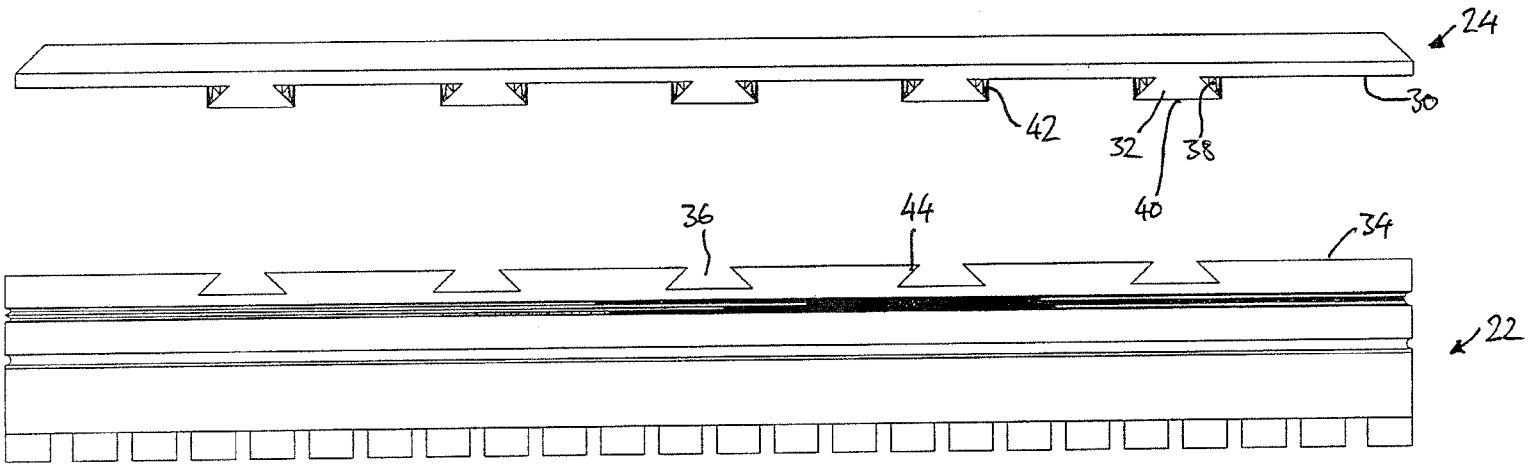
FIG. 7 is an exploded top view of the building block of FIG. 1.

Referring in particular to FIGS. 5, 6 and 7, the projections 32 on the rear face 30 of the facing 24 have a complementary shape to the recesses 36 in the front face 34 of the body 22. The recesses 36 are in the shape of channels which extend from the top to the bottom of the body. The opposing walls of the channels are generally inclined and diverge outwardly moving rearwardly from the front face 34 of the body 22, thereby to form a dovetail mitre, having an overhanging lip 44 on both sides thereof.

Additionally, as shown in FIG. 6, each of the recesses 36 includes two pairs of oppositely-facing arcuate wall portions 46. Each pair of arcuate wall portions 46 can be considered to define a cylindrical bore in the front face 34 of the body 22, having a cylinder axis extending normal to the front face 34. Thus each recess 36 incorporates a linear portion, in the form of a dovetail mitre, which extends vertically on the front face 34 of the body 22, and arcuate wall portions 46 which curve outwardly from the linear portion in a horizontal direction.

The arcuate wall portions 46 of the recesses 36 accommodate the arcuate wall portions 42 of the projections 32. Thus, in the building block 20, the projections 32 and the recesses 36 interlock so as to hold the facing 24 securely on the body 22.

As will now be described, the projections 32 and the corresponding recesses 36 are shaped so as to guard against relative movement of the facing 24 and the body 22 in any direction.

The overhanging lips 44 of the recesses 36 extend into the undercut regions of the projections 32, so as to guard against movement of the facing 24 in a direction normal to the front face 26 of the facing 24. Said another way, the dovetail tenons defined by the projections 32 cooperate with the dovetail mitres defined by the recesses 36 interlock to prevent the facing 24 being pulled away from the body 22.

Furthermore, the inclined side walls 38 of the projections 32 abut the walls of the channels which form the recesses 36, so as to guard against relative sideways, i.e. horizontal, movement of the facing 24 and the body 22.

Finally, the arcuate wall portions 42 of the projections 32 engage with the corresponding arcuate wall portions 46 of the recesses 36, preventing relative upward or downward, i.e. vertical, movement of the facing 24 with respect to the body 22. Said another way, the interaction of the arcuate wall portions 42 of the projections 32 and the arcuate wall portions 46 of the recesses 36 prevents the facing 24 from slipping downwards on the body 22 under the force of gravity when the building block 20 is installed in the orientation shown in FIG. 1.

In general, therefore, the walls of the projections 32 and recesses 36 comprise engagement surfaces of the facing 24 and the body 22, respectively. The engagement surfaces of the body 22 are oriented with respect to the front face 34 of the body 22 in such a manner as to form an interlock with the engagement surfaces of the facing 24. The interlock thus formed guards against relative movement of the facing 24 with respect to the body 22 in three mutually perpendicular directions. In this embodiment, the three directions lie normal to the front face 34 of the body 22, horizontally, and vertically, as described above, but it will be understood that orienting the engagement surfaces of the body 22 so as to prevent relative movement in any three mutually perpendicular directions will have the desired effect.

It is to be noted that this arrangement of recesses 36 and complementary projections 32 does not rely merely on an interference fit to engage the facing 24 with the body 22. Instead, the body 22 is shaped to interlock with the facing 24 to guard against movement of the facing 24 with respect to the body 22 in every direction. Consequently, the facing 24 is held securely on the body 22, and is not vulnerable to detachment due to vibrations, mechanical shock, differential thermal expansion of the body 22 and the facing 24 and so on.

Figure 2:
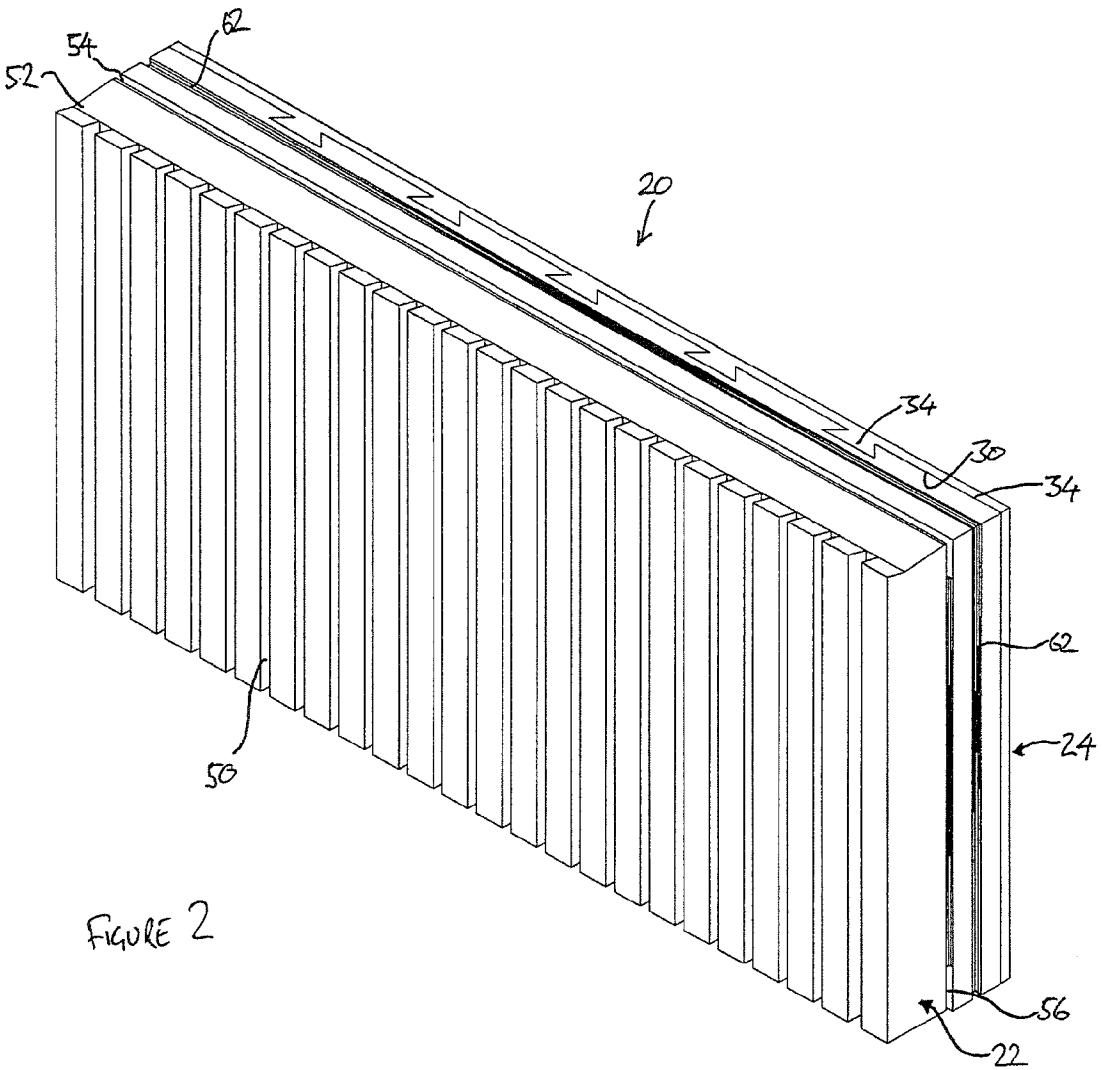
FIG. 2 is a perspective view, from the rear, of the building block of FIG. 1.
Figure 3:
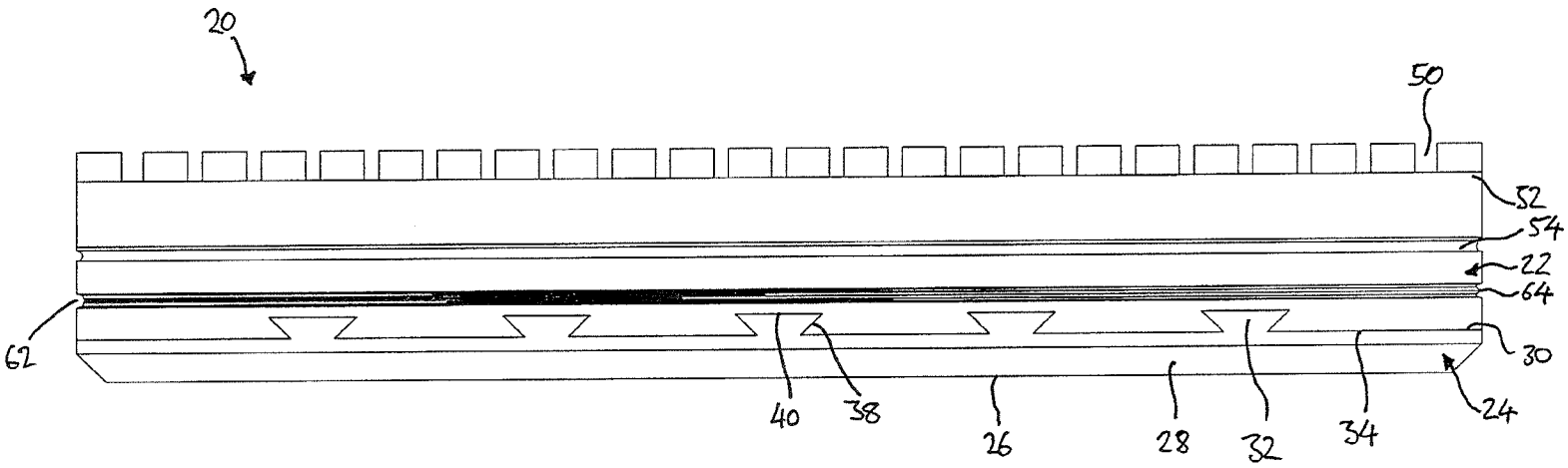
FIG. 3 is a top view of the building block of FIG. 1.
Figure 4:
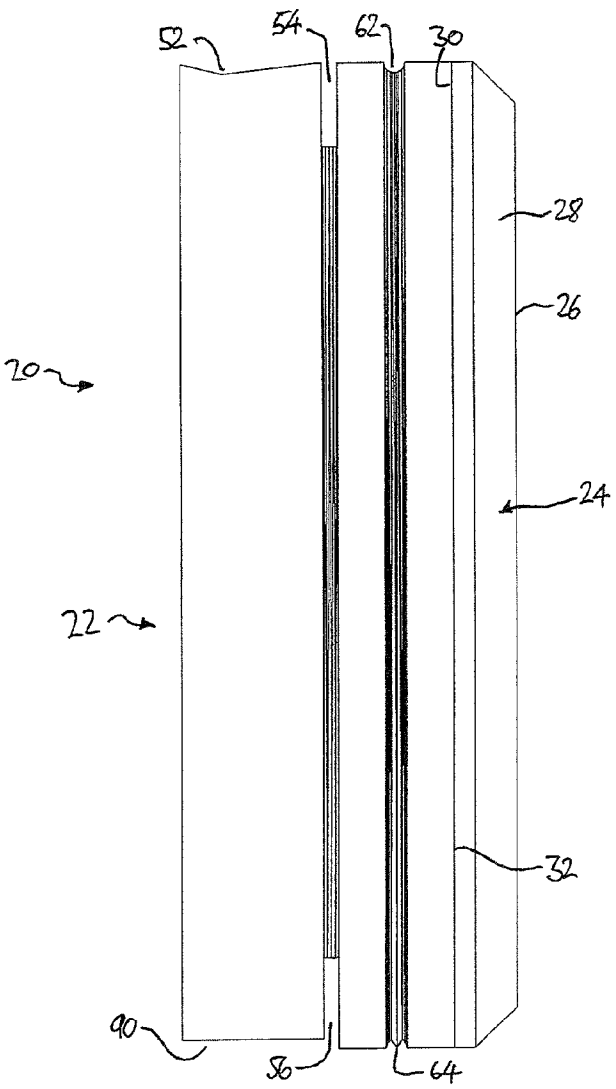
FIG. 4 is a side view of the building block of FIG. 1.

As seen most clearly in FIG. 2, the body 22 of the building block 20 is provided with an array of vertically-extending drainage channels 50 on its rear face. The channels 50 allow water to drain down the back of the block 20 in use. The body 22 is also provided with a shallow V-shaped groove 52 in its top face, as shown in particular in FIG. 4. The groove 52 acts as a gutter to direct water from the top face of the block 20 toward the channels 50.

An upper bracket-receiving channel or recess 54 (also known as a bracket engaging formation) is formed in the top face of the body 22, and a lower bracket-receiving channel or recess 56 is formed in the bottom face of the body 22. As will be described in more detail below, the upper and lower bracket-receiving recesses 54, 56 are arranged to cooperate with support brackets when the building block 20 is used in a cladding system. The body 22 is further provided with grooves 62, 64 on the top, bottom and side faces thereof for receiving a bead of sealing material, as will also be described further below.

A method of manufacturing building blocks will now be described with reference to FIGS. 8 to 11. The method is particularly suitable for manufacturing the building blocks described above with reference to FIGS. 1 to 7, but it will be appreciated that the method could also be used for manufacturing other types of building block having a body and a facing.

Figure 8:
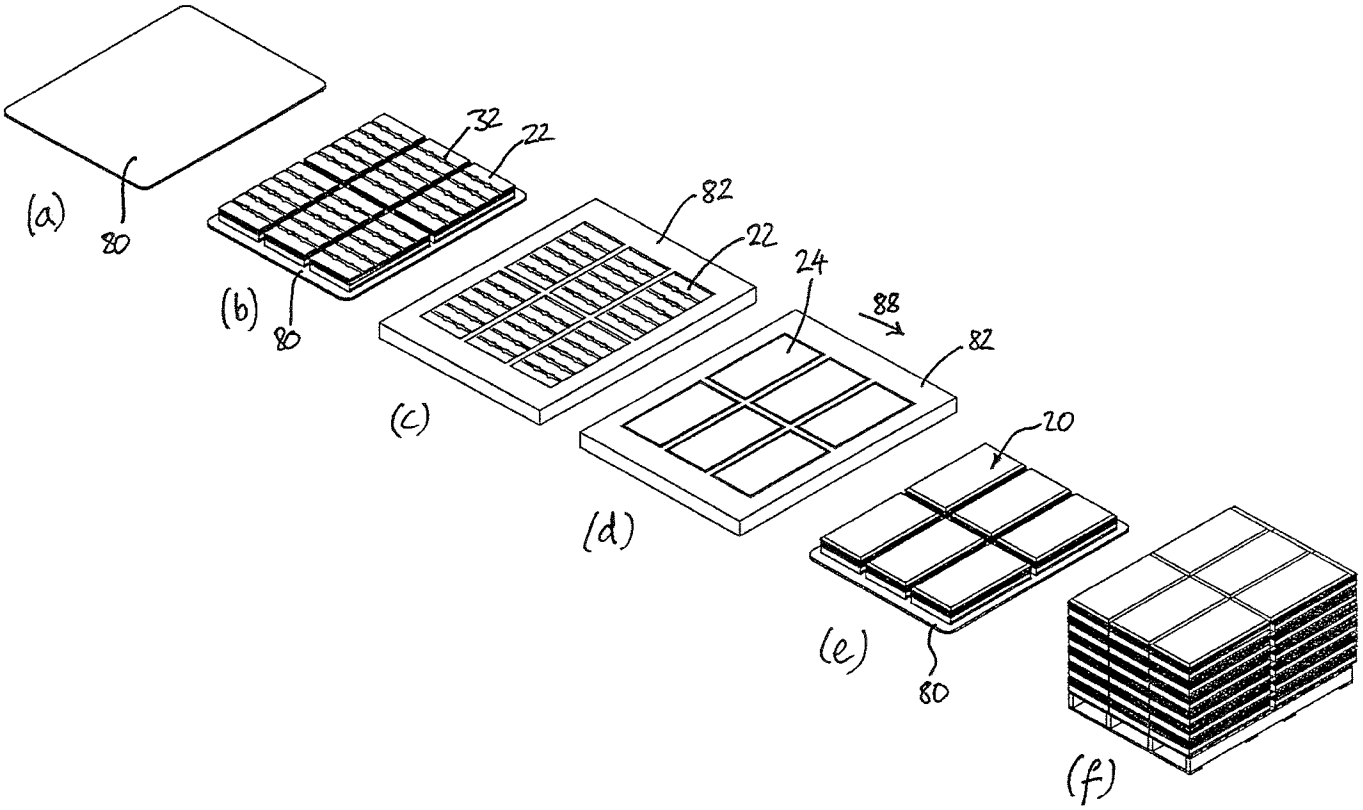
FIG. 8 shows, schematically and in perspective view, a sequence of steps in the manufacture of a plurality of building blocks of the type shown in FIGS. 1 to 4.
Figure 9:
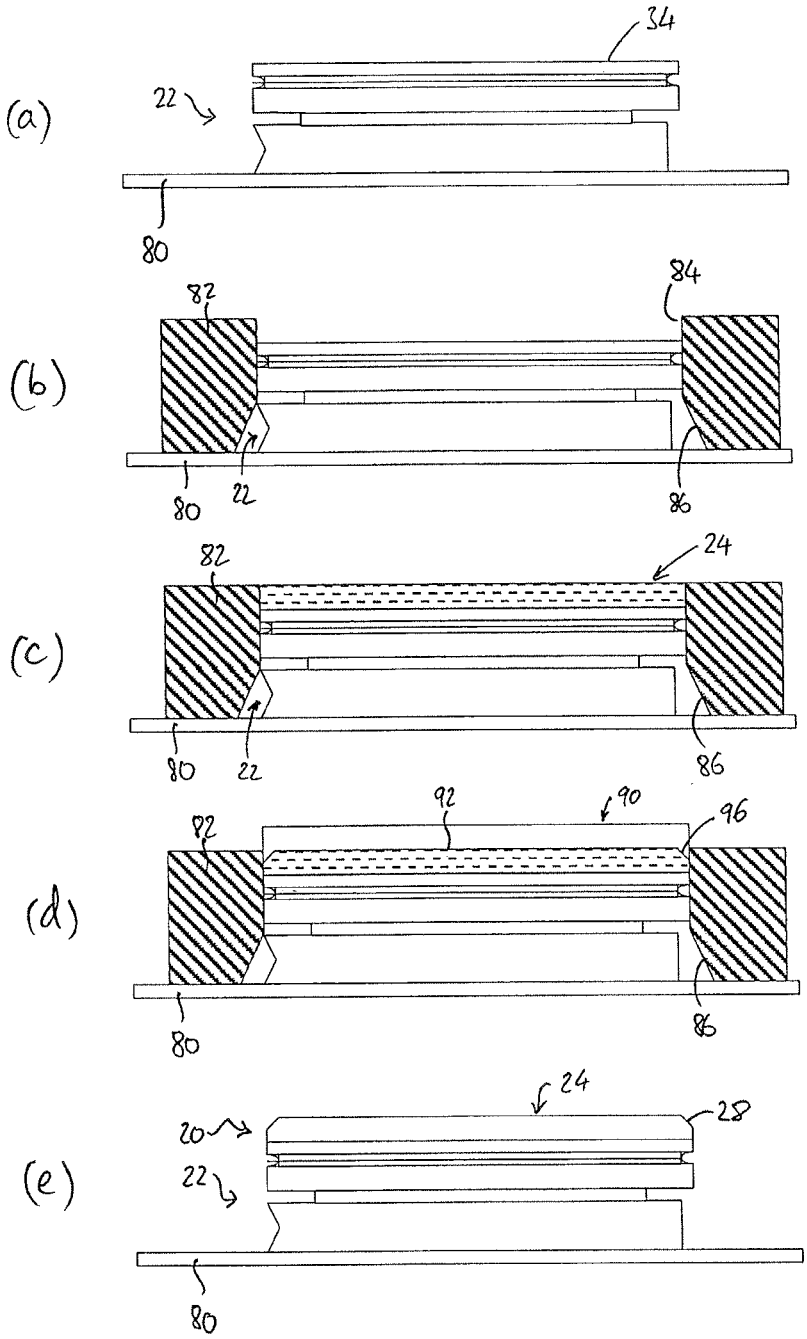
FIG. 9 shows, in part-sectional side view, some of the steps in the manufacturing process of FIG. 8.
Figure 10:
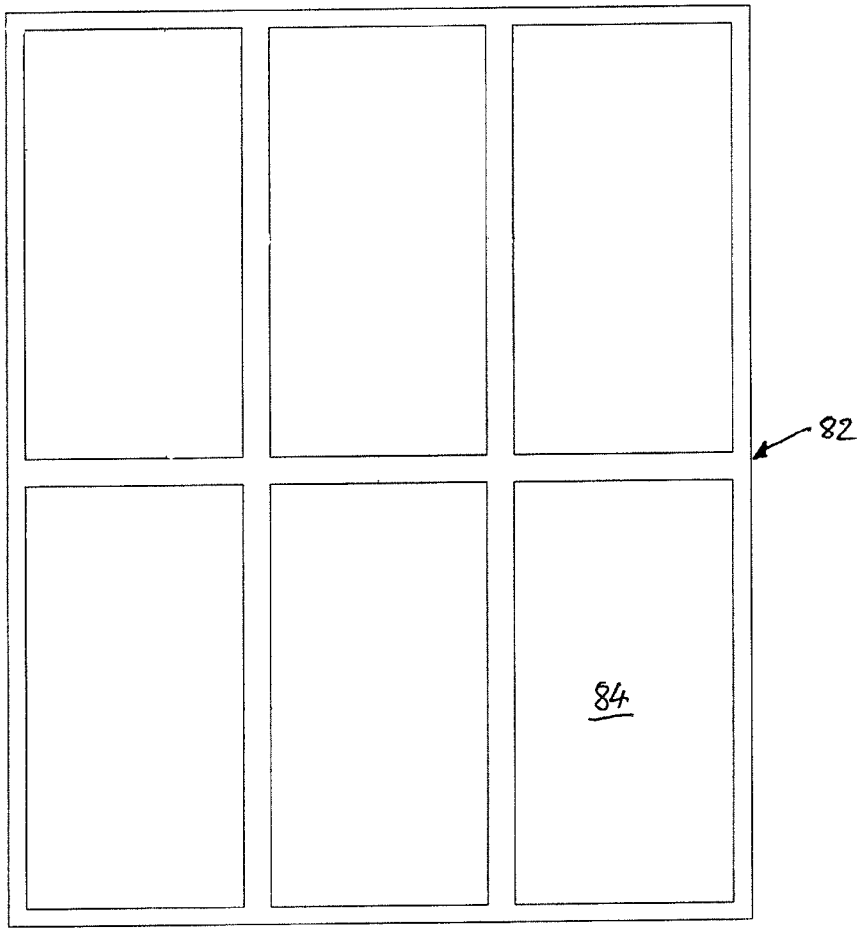
FIG. 10 is a top view of a mould frame used in the manufacturing process of FIG. 8.
Figure 11:
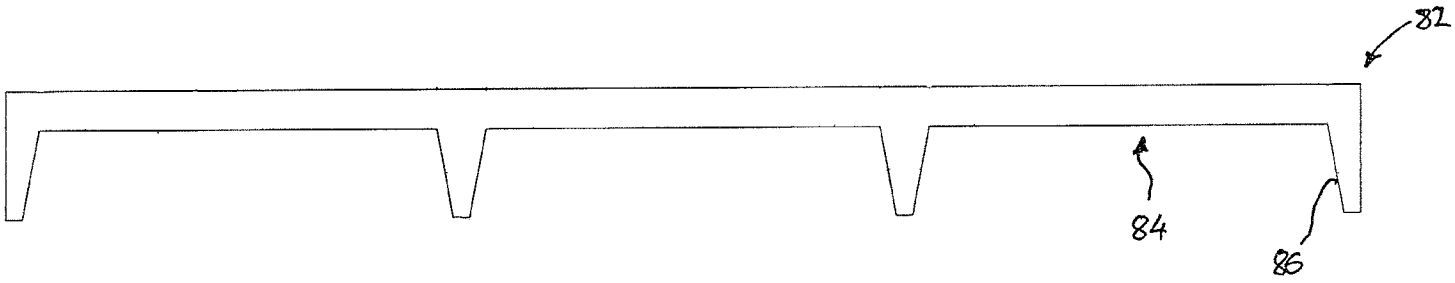
FIG. 11 is a cross-sectional side view of the mould frame of FIG. 10.

FIG. 8 shows a plurality of blocks 20 being made simultaneously, while FIG. 9 shows the processing steps for one such block 20.

As shown in FIG. 8(*a*), the blocks are manufactured by building up the blocks as they are transported along a manufacturing line (not shown) on a pallet 80. A plurality of block bodies 22 are arranged on the pallet 80, as shown in FIGS. 8(*b*) and 9(*a*), so that the recesses 32 are uppermost.

A mould frame 82 is then placed around the bodies 22, as shown in FIGS. 8(*c*) and 9(*b*). The mould frame 82 is shown in more detail in FIGS. 10 and 11. The mould frame 82 comprises a plurality of openings 84, each configured to fit tightly around a respective body 22. As shown most clearly in FIGS. 9(*b*) and 11, the mould frame 82 includes a flared region 86 at the bottom end of each opening 84. The flared region 86 aids alignment of the mould frame 82 with each body 22.

Once the mould frame 82 is in place, the facing 24 of the block is formed by pouring a settable material, such as a wet cementitious mixture which hardens on exposure to air, into the opening 84 to fill the gap between the front face 34 of each body 22 and the top of the mould frame 82, as shown in FIGS. 8(*d*) and 9(*c*). The cementitious mixture is poured in such a way that the recesses 32 in the body 22 are completely filled by the cementitious mixture, for example by pouring the concrete in a direction perpendicular to the long axes of the recesses 32, as indicated by arrow 88 in FIG. 8(*d*).

Figure 12:
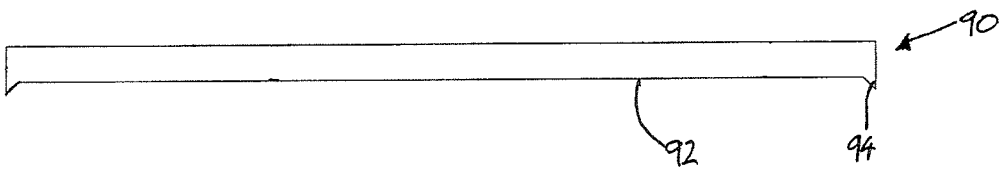
FIG. 12 is a cross-sectional side view of a mould shoe used in the manufacturing process of FIG. 8.

Mould shoes 90, one of which is illustrated in FIG. 12, are then pressed down onto the wet cementitious mixture in each aperture 84 of the mould frame 82, as shown in FIG. 9(*d*). Each shoe 90 includes on its undersurface 92 a relief pattern, so that any desired decorative relief features or texture patterns are transferred to the surface of the facing 24 when the shoe 90 presses on the wet cementitious mixture. The shoe 90 also includes a chamfered lip 94 around the periphery of its undersurface 92, which moulds the chamfered edge 28 of the facing 24 of each block 20.

The cementitious mixture is compacted by the mould shoe 90 to ensure that the facing 24 is free from pores and other defects, and to ensure that the recesses 32 are filled by the facing material.

Once the cementitious mixture has set sufficiently, the mould frame 82 is removed from the pallet 80. The finished blocks 20, as shown in FIGS. 8(*e*) and 9(*e*), are then removed from the pallet 80 and stacked as shown in FIG. 8(*f*) to allow the facings 24 to set fully. The stack of blocks 20 can be packaged for storage and transportation.

Although the body 22 and the facing 24 are shown separated from one another in FIGS. 5, 6 and 7, it will be appreciated that since the body 22 acts as a mould to form the projections 32 of the facing 24, the facing 24 is permanently attached to the body 22 and is not removable.

Furthermore, since the body 22 acts as a mould for the facing 24, the shape of the body alone gives rise to the engagement between the body 22 and the facing 24, which guards against relative movement of the facing 24 with respect to the body 22 in any direction as described above.

The thickness of the facing 24 is determined by the size of the gap between the front face 34 of each body 22 and the top of the mould frame 82, as shown in FIGS. 9(*b*) and 9(*c*). Optionally, the mould frame 82 comprises a stack of removable mould plates (not shown) so that, by adding or removing plates, the size of the gap, and hence the thickness of the facing 24, can be adjusted.

It will be appreciated that the arrangement of projections 32 and recesses 36 described above is only one example of a suitable arrangement. The recesses in the front face of the body could instead comprise separate dovetail mitres and cylindrical bores, inclined, curved or 's'-shaped dovetail mitres, one or more rectangular recesses having undercut regions on one or more sides, an array of circular recesses having undercut sides and so on. The recesses could also take the form of an undercut groove which extends around the periphery of the front face of the block.

A cladding system utilising the blocks 20 will now be described with reference to FIGS. 13 to 19.

Figure 13:
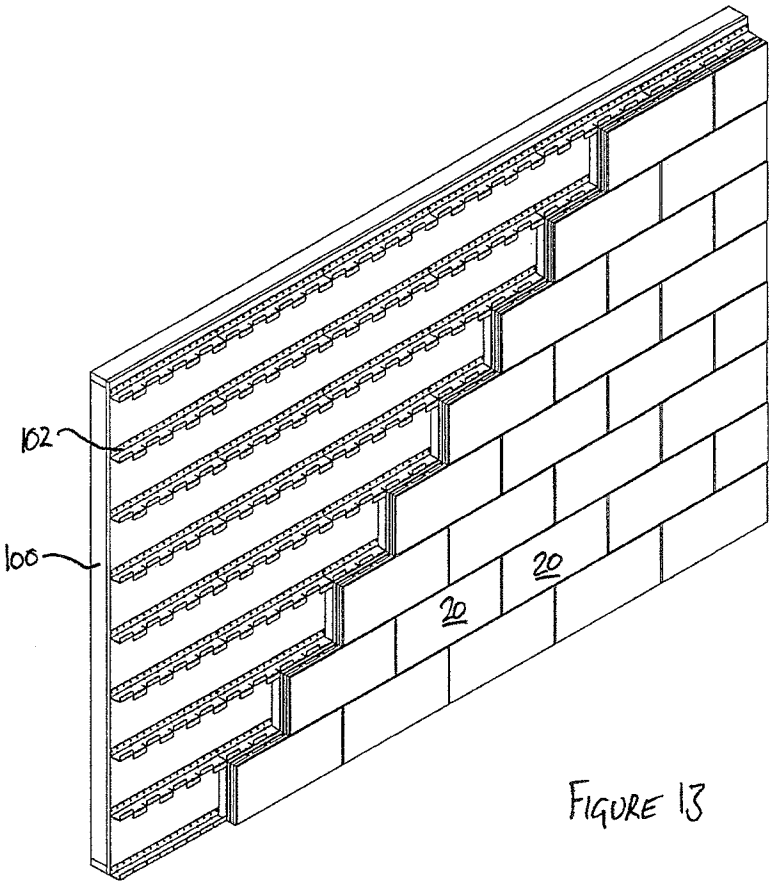
FIG. 13 is a perspective view of a wall that has been partially clad using a cladding system comprising a plurality of building blocks of the type shown in FIGS. 1 to 4, and a plurality of support brackets.

The cladding system, shown generally in FIG. 13, comprises a plurality of blocks 20 of the type shown in FIG. 1, which are supported on an inner wall 100 by a plurality of support brackets 102. The inner wall 100 may be made from a conventional building material, such as brick, block, timber or masonry.

Figure 14:
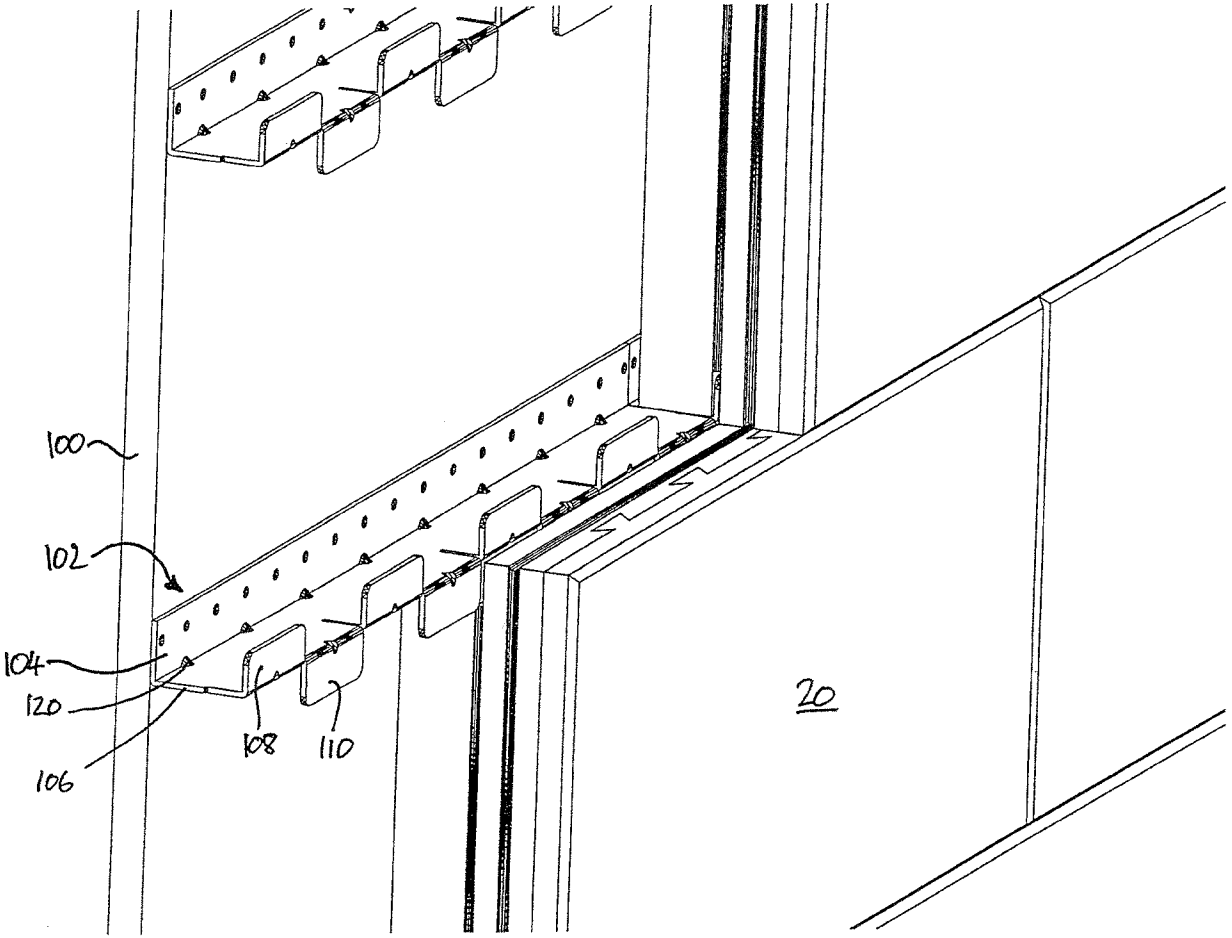
FIG. 14 is a perspective view of the partially clad wall of FIG. 13 showing, in greater detail, the building blocks and the support brackets.

As shown most clearly in FIG. 14, each of the support brackets 102 comprises an upstanding mounting member 104 at the rear of the bracket, a horizontal base member 106 connected at its rear edge to the mounting member 104 to form an L-shaped section, and alternating upwardly-extending and downwardly-extending fingers or elements 108, 110 connected to the front edge of the base member 106. Conveniently, the mounting member 104, base member 106 and fingers 108, 110 are formed by cutting or stamping and then bending a piece of sheet material such as steel, so that each support bracket 102 is integrally formed. Alternatively, the support brackets 102 may be formed from a reinforced plastics material, for example by injection moulding or by another suitable manufacturing method.

Figure 15:
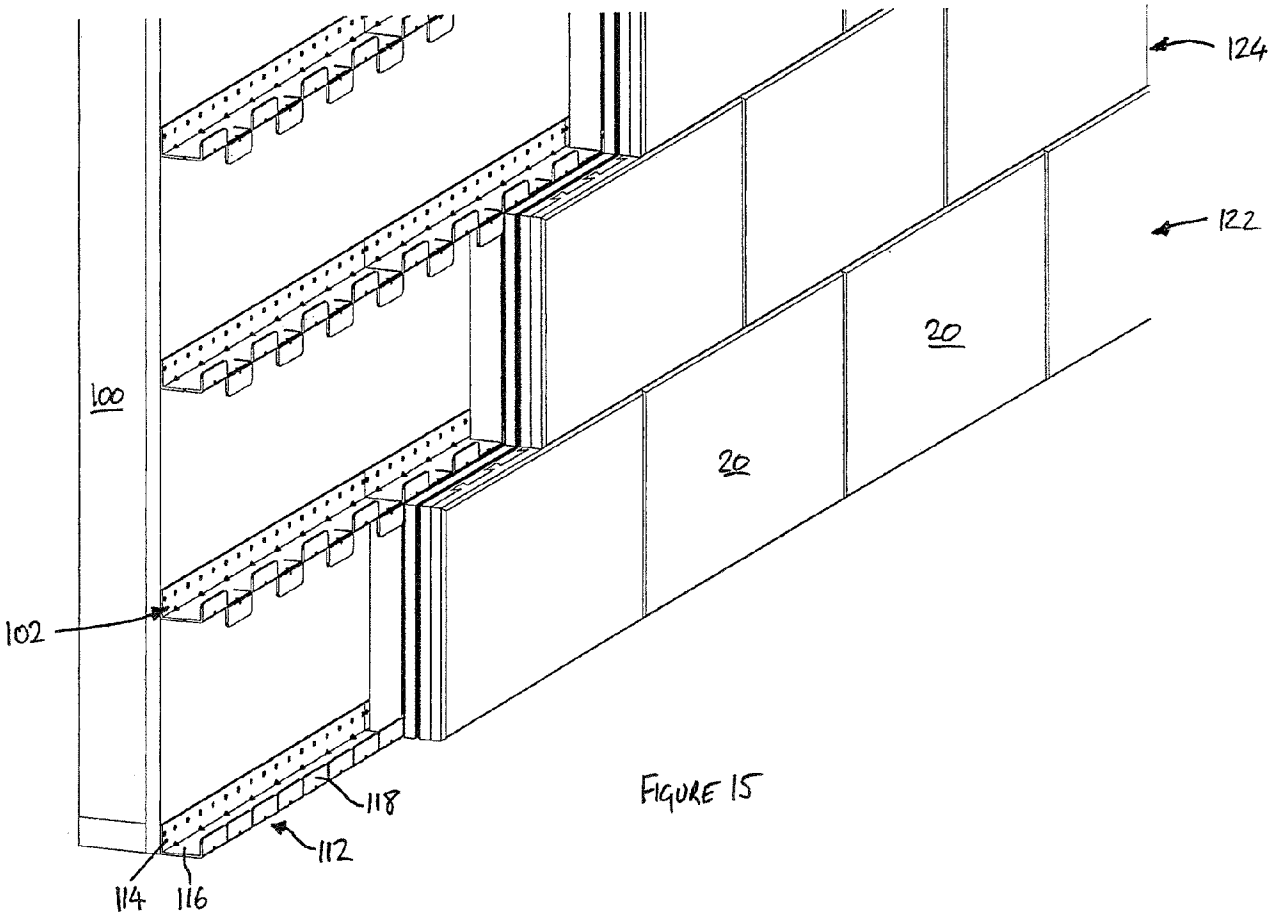
FIG. 15 is a perspective view of the partially clad wall of FIG. 13 showing, in greater detail, the building blocks, the support brackets, and a bottom support bracket.

As shown in FIG. 15, the cladding system also includes a base bracket 112 having an upstanding rear mounting member 114, a horizontal base member 116 and an upstanding front wall 118 comprising a plurality of upwardly-extending fingers. The mounting member 114 and front wall 118 of the base bracket 112 are connected to rear and front edges of the base member 116 respectively, so that the base bracket 112 has a J-shaped cross section. The base bracket 112 may also be integrally formed from a sheet material.

The support brackets 102 and base bracket 112 include strengthening ribs 120 to ensure that the brackets 102, 112 are sufficiently rigid to bear the weight of the blocks 20. The support brackets also include drainage holes or slits (not shown) to allow drainage of moisture in the space between the blocks 20 and the inner wall 100 and to allow air to circulate within that space.

To clad the inner wall 100, the base bracket 112 is first fixed to the inner wall 100 by screwing, nailing or otherwise attaching its mounting member 114 to the inner wall 100. A first row or course 122 of blocks 20 is then assembled on the base bracket 112 as will now be described.

A first block 20 is placed on the base bracket 112 so that the upstanding front wall 118 of the base bracket 112 locates in the lower recess 56 of the block 20. A bead of sealing compound is then applied to one of the grooves 62, 64 in a side face of the block 20.

A second block 20 is then placed on the base bracket 112, leaving a horizontal gap between the first and second blocks 20. The second block 20 is then slid horizontally along the base bracket 112, so as to close the gap and cause the sealing compound to form a seal between the vertical faces of the blocks 20, as will be described in more detail below. This process is repeated to form the first course 122 of blocks along the required length of the inner wall 100.

A support bracket 102 is then placed on top of the first course 122, so that the downwardly extending fingers 110 of the support bracket 102 locate in the upper recesses 54 of each of the blocks 20 in the first course 122. The mounting member 104 of the support bracket 102 is fixed to the inner wall 100 using screws, nails or another suitable method.

Figure 16:
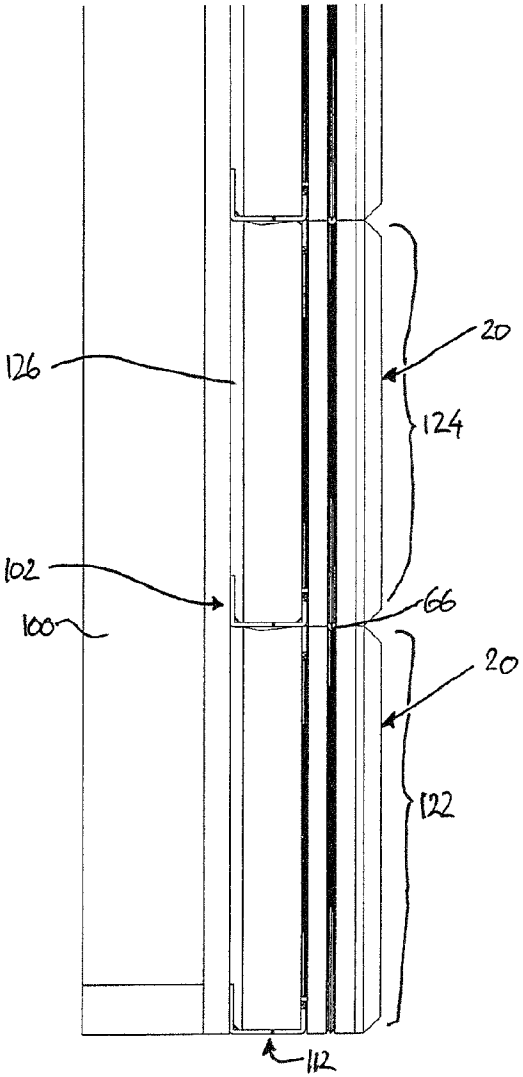
FIG. 16 is a side view of the partially clad wall of FIG. 13.

By virtue of this arrangement, each block 20 in the first course 122 is attached securely to the wall by the base bracket 112 and the support bracket 102, as shown also in FIG. 16.

Another bead of sealing compound is applied to the groove 62 in the upper face of the blocks 20 of the first course 122. The second course 124 of blocks 20 is then laid on top of the support bracket 102, in a similar way to the first course 122, so that the sealing compound forms a seal between the first course 122 and the second course 124 of blocks 20, as well as between each neighbouring block 20 in the second course 124.

The upwardly extending fingers 108 of the support bracket 102 locate in the lower recesses 56 of each of the blocks 20 in the second course 124. This arrangement ensures that the second course 124 is in alignment with the first course 122.

Further courses of blocks 20 are then added by repeating the process used to form the second course 124. In this way, each block 20 in the second and higher courses of blocks 20 is held by the support brackets 102 above and below each block 20.

As shown most clearly in FIG. 16, the base bracket 112 and support brackets 102 are dimensioned so that a cavity 126 is formed between the blocks 20 and the inner wall 100. Moisture that passes through the blocks 20 of the cladding can evaporate from the cavity 126 to ensure that the inner wall 100 remains dry. The cavity 126 also increases the thermal insulating properties of the clad wall.

Referring back to FIG. 4, the body 22 of each block 20 includes a cutaway 90 in its bottom face. The cutaway 90 is sufficient to accommodate the base member 106 of a support bracket 102, so that when the block is mounted on the support bracket 102 in a second or higher course of blocks 20, the front face 34 of the body 22 lines up alongside the front face 34 of the body 22 of the neighbouring block 20 in the course below and the grooves 62, 64 in the blocks 20 align to form a cavity 66 for the sealing material.

In this way, the bodies 22 of the blocks 20 in the cladding abut their respective neighbours, thereby forming an effectively continuous insulating cladding on the inner wall 100 with no gaps or so-called 'cold bridges' through the structure.

Figure 17:
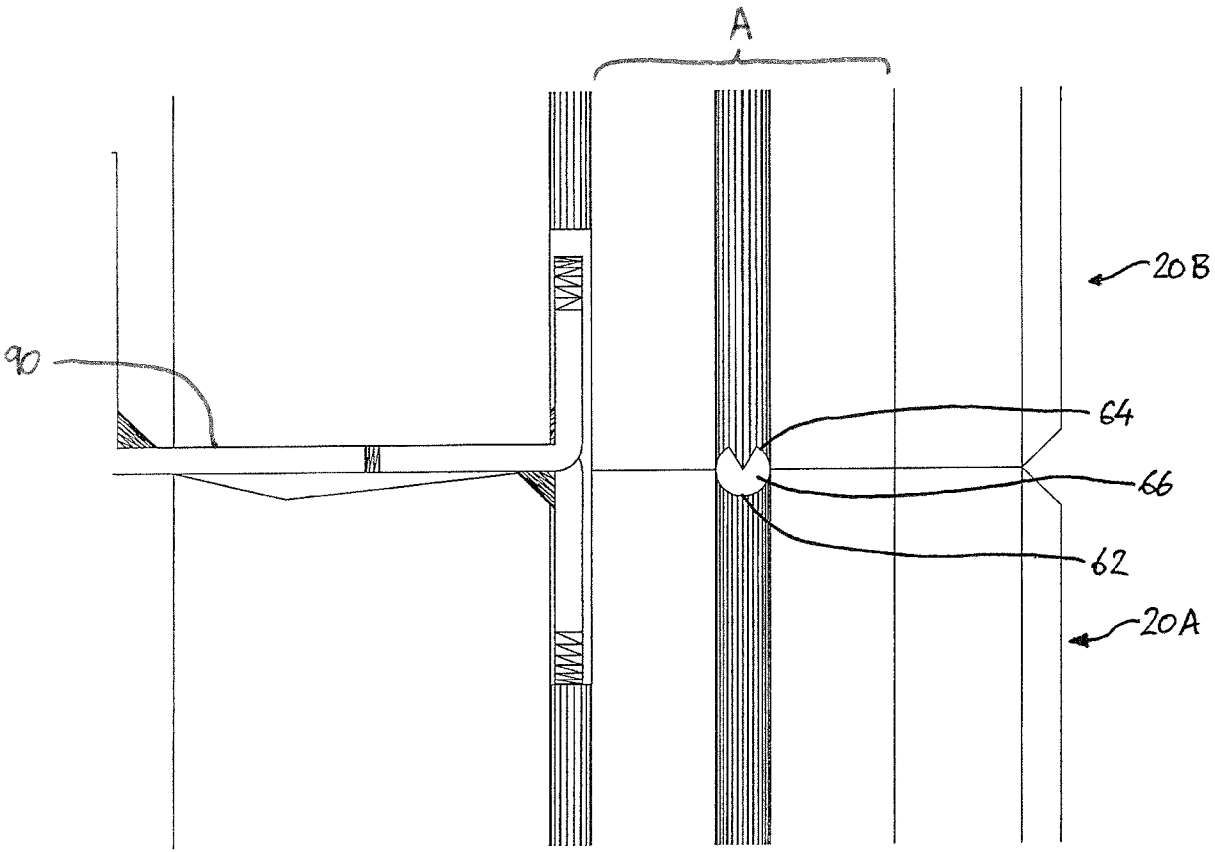
FIG. 17 is a vertical cross-sectional view showing part of two vertically neighbouring building blocks in the cladding system of FIG. 13.

Referring to FIG. 17, the cutaway 90 extends across only a portion of the depth of the bottom face, so that a remaining portion (labelled 'A' in FIG. 17) of the body abuts the top face of the body of the block below. By virtue of the body-to-body frictional contact across a region A of the top and bottom faces, water penetration between the blocks is limited or prevented. Also, the abutting contact between the bodies over the contact region A ensures that the bodies of the blocks provide an uninterrupted thermal insulation layer behind the facings of the blocks.

The facings 24 of neighbouring blocks 20 are not, however, in load-transferring contact. Instead, a small gap (not shown) exists between neighbouring facings 24, which may be achieved by ensuring that the facings 24 are somewhat smaller in area than the corresponding bodies 22. This means that the relatively high weight of the facing 24 of a block is not carried by the facings of the blocks below. Rather, the weight of the facing 24 is transferred via the support brackets 102 to the inner wall 100.

As described above, when neighbouring blocks 20 are assembled together to form a cladding for a wall or a similar structure, a sealing compound such as mastic, silicone sealant, putty or a similar material is applied between the blocks 20 to reduce further the amount of water and, particularly wind that can pass through the assembly of blocks 20. In this embodiment of the invention, the grooves 62, 64 are adapted to ensure that the seal formed by the sealing material is particularly effective. It will be appreciated that such grooves could advantageously be provided in any type of building block, not just those described above.

FIG. 17 is an enlarged view of part of FIG. 16, showing the meeting point of two neighbouring blocks 20A, 20B in adjacent courses. As shown also in FIGS. 3, 4 and 7, the top and left-hand side faces of the body 22 are provided with a generally U-shaped groove 62. The bottom and right-hand side faces of the body 22 are provided with a generally W-shaped groove 64; that is, this groove 64 has a central projection or ridge, corresponding to the peak of the W, which extends along the length of the groove.

In use, a bead of sealing compound is applied to the groove 62, 64 of the first block 20A, and the second such block 20B is placed in a neighbouring relationship with the first block 20A as described above. The grooves 62, 64 in the neighbouring blocks line up to define a cavity 66 for the sealing compound.

In FIG. 17, the U-shaped groove 62 in the top face of the lower block 20A, into which the bead of sealing compound has been placed, is aligned with the W-shaped groove 64 in the bottom face of the upper block 20B, so as to from the cavity 66 for the sealing compound.

The ridge of the W-shaped groove 64 projects inwardly into the cavity 66. Thus, when the upper block 20B is placed on top of the lower block 20A, the ridge pushes into the sealing compound, squeezing it firmly against the walls of the cavity 66. In this way, the sealing compound forms a substantially water-tight seal between the neighbouring blocks 20A, 20B.

Figure 18:
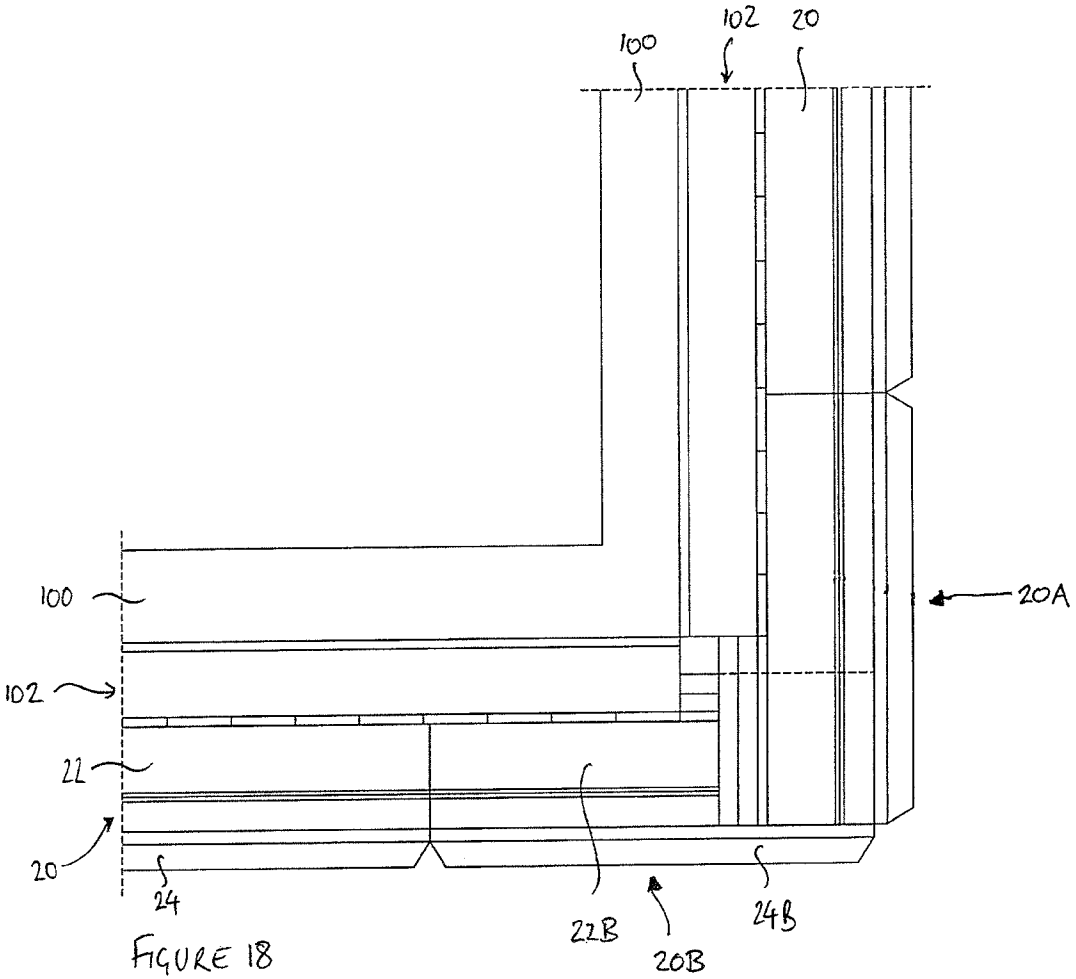
FIG. 18 is a plan view showing a corner in a wall clad with the cladding system of FIG. 13.

The cladding system can be readily adapted to clad an external corner. FIG. 18 shows a course of blocks 20 at such a corner, viewed from above so that the support brackets 102 which lie above the tops of the blocks 20 can be seen.

On one side of the corner, the course of blocks ends with an end block 20A which extends beyond the wall 100 and the support bracket 102 by a distance equal to the depth of the cavity between the blocks and the wall 100 plus the depth of the body 22 of a block 20. The end block 20A is, however, identical to the block 20 shown in FIG. 1.

Figure 19:
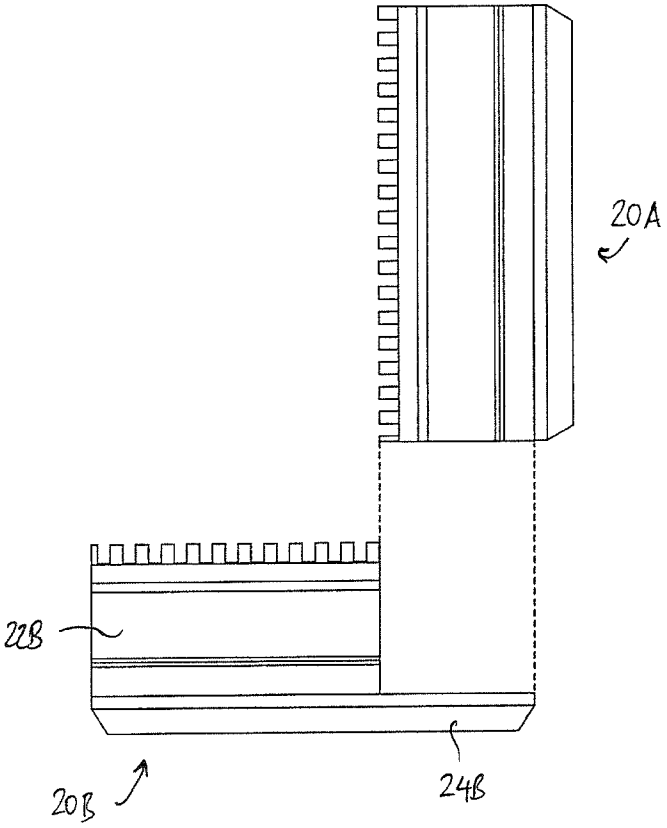
FIG. 19 is an exploded drawing in plan view of two building blocks arranged to form the corner shown in FIG. 18.

On the other side of the corner, the course of blocks ends with a corner block 20B in which the body 22B has been cut away, as shown in FIG. 19, leaving its face 24B extending beyond its body 22B by a distance equal to the depth of the body 22B. As illustrated in FIG. 18, the end block 20A and the corner block 20B can be arranged so that their respective faces 24A, 24B meet at the corner.

In this case, the body 22 of each block 20 is made from a cuttable material such as polystyrene. Therefore the body 22 can be easily cut away to form a corner block 20B such as that shown in FIGS. 13 and 14. Thus it is not necessary to include specially-shaped blocks for corners and similar features in the cladding system. Conveniently, the blocks 20 may be provided with cutting guides, such as embossed lines on the rear, top and/or bottom faces of the body 22, so that the blocks 20 may easily be converted to corner blocks 20B when required on-site.

It will be appreciated that the facings 24 of the blocks 20 can be decorative in nature. For example, the facings 24 could be textured, polished, coloured, coated, glazed, painted, printed or otherwise treated to provide a desired decorative effect. In this way, a cladding arrangement as shown in FIGS. 13 to 19 can be made to have the appearance of, for example, a masonry wall.

Figure 20:
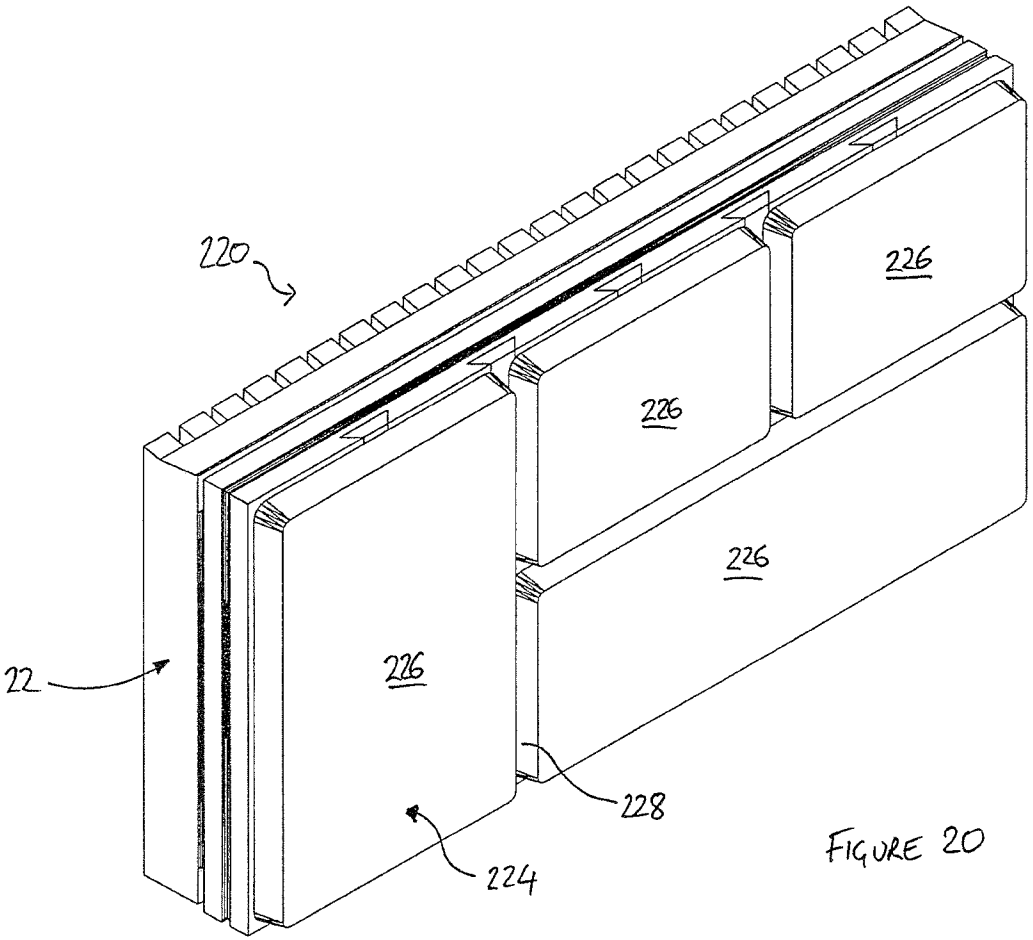
FIG. 20 is a perspective view, from the front, of a variant of a building block according to the present invention, having a decorative appearance.
Figure 21:
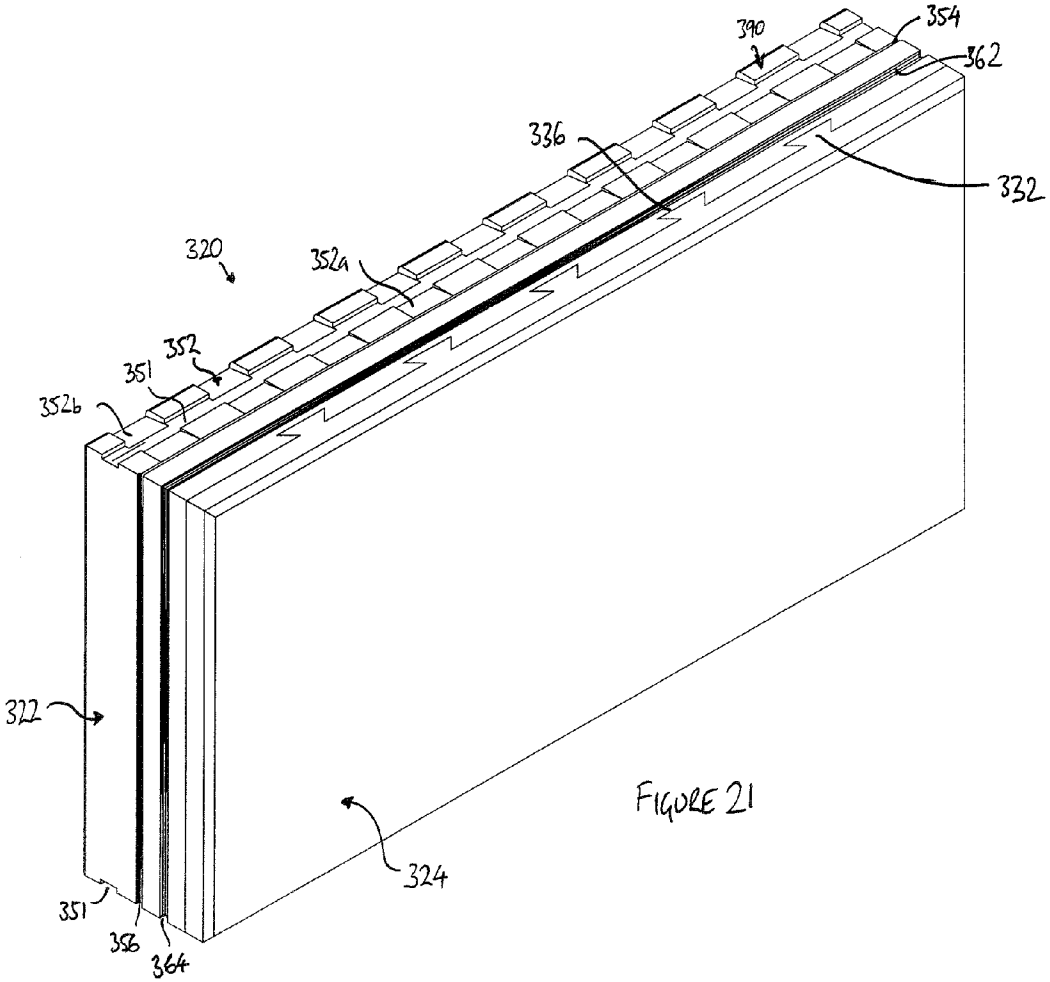
FIG. 21 is a perspective view, from the front, of a building block according to another embodiment of the present invention.

The building block 220 shown in FIG. 20 is an example of a building block according to the invention having a decorative facing 224. In this case, a decorative effect has been applied to the facing 224 so that the facing 224 has the appearance of being made up of several small blocks 226, separated by grooves 228. The grooves 228 have the appearance of joints between the small blocks 226. When a plurality of such blocks 220 are assembled into a cladding or wall, the resulting wall has the appearance of a dressed stone or 'ashlar' wall. In the illustrated example, four small blocks 226 are shown, but it will be appreciated that a different number of small blocks 226 could be present.

The grooves 228 may be formed by providing a suitable pattern of ridges on the mould shoe 90, so that, when the mould shoe is pressed into the facing 224 during manufacture of the block 220 as described with reference to FIGS. 8 and 9, an impression of the ridges is left in the facing 224.

In a variant of the building block 220, the small blocks are separated by regions of the facing that are printed to give the appearance of grooves or joints between the small blocks, even though the facing is substantially planar in this variant.

In another variant, the facing of the block is given the appearance of wood shakes or shingles, for example by printing the facing or by applying a transfer to the facing, which may optionally also be textured to give a grained effect and/or grooved to give the appearance of gaps between adjacent shingles. In still another variant, the facing of the block carries a printed or embossed logo or other graphic device.

When used in a cladding arrangement, the facings 24 of the blocks 20 provide a weather-deflecting skin to the cladding. In particular, the facings 24 deflect most of the incident water that falls on the cladding. In severe conditions, such as driving rain, some water may pass between the facings 24. However, the abutment of the bodies of the blocks, along with the sealing material between the blocks 20, helps to prevent water ingress past the bodies 22 of the blocks 20. Even if water does pass behind the blocks 20, the water enters the cavity 126 whereupon most of it evaporates. However, any residual water can drain down the channels 50 in the back of the blocks 20. Drainage holes or slits are provided in the support brackets 102 to allow the water to pass the support brackets 102, so the drained water can reach the base of the wall and soak away.

The cladding system also provides a highly-efficient method for thermally insulating a wall, by virtue of the cavity 126 between the inner wall 100 and the blocks 20, the insulating material of the bodies 22 of the blocks 20, and the absence of continuous heat-conducting features, sometimes known as thermal bridges, between the facings 24 of the blocks 20 and the wall 100. These features, in combination, mean that the cladding system has a high R-value.

Another embodiment of a building block 320 according to the invention is shown in FIGS. 21 to 24. The building block 320 of FIGS. 21 to 24 is similar to the building block 20 described with reference to FIGS. 1 to 4, and so only the differences will be described in detail.

The building block 320 comprises a body 322 of expanded polystyrene or a similar material, and a facing 324 of cementitious material attached thereto. The facing 324 is engaged with the body 322 by way of cooperating projections 332 of the facing and recesses 336 in the body 322, as previously described with reference to FIGS. 1 to 4.

The body 322 is provided with upper and lower bracket-receiving recesses 354, 356 that cooperate with support brackets when the building block 320 is used in a cladding system, as previously described. Furthermore, as for the block of FIGS. 1 to 4, the body 322 is provided with grooves 362, 364 on the top, bottom and side faces thereof for receiving a bead of sealing material.

Figure 22:
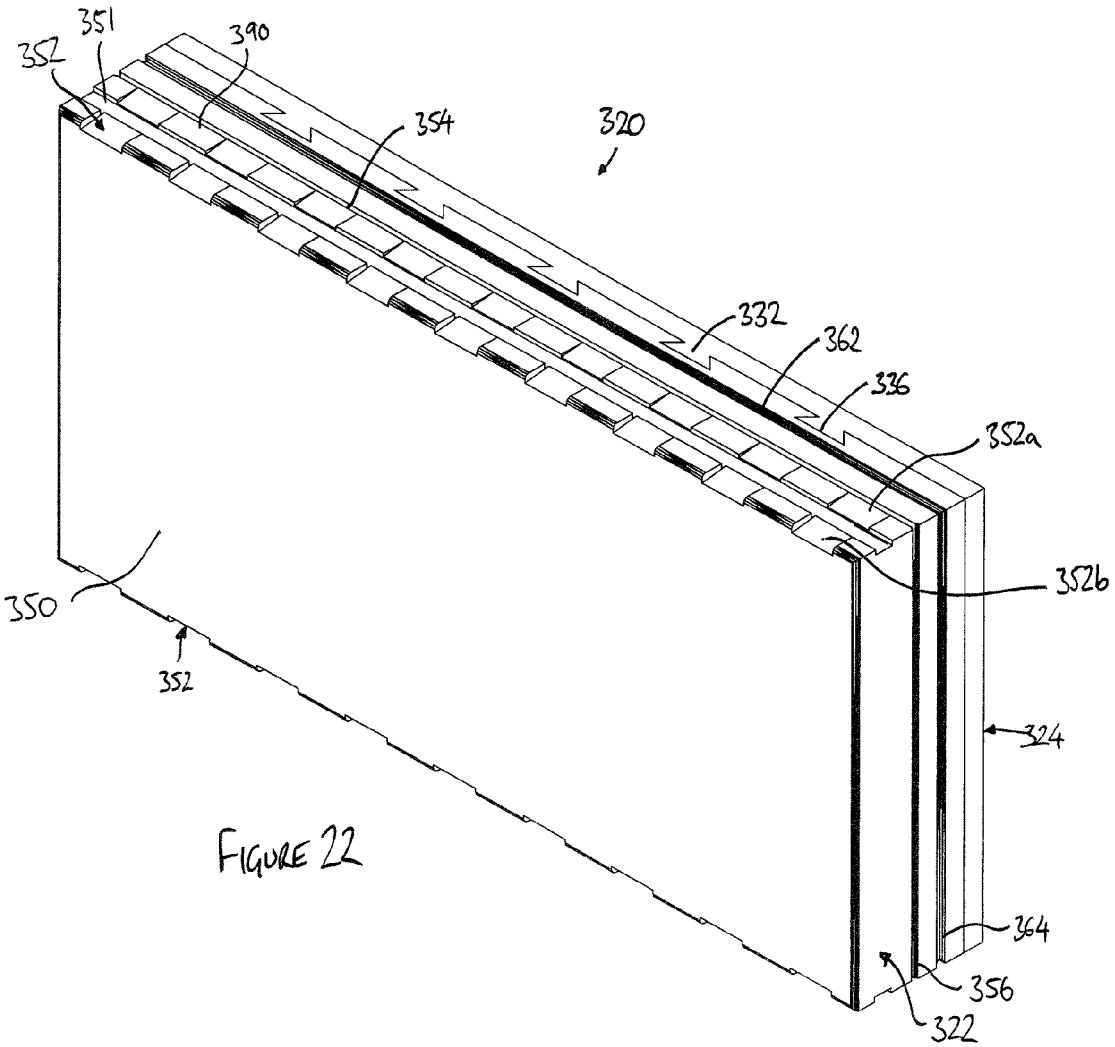
FIG. 22 is a perspective view, from the rear, of the building block of FIG. 21.
Figure 23:
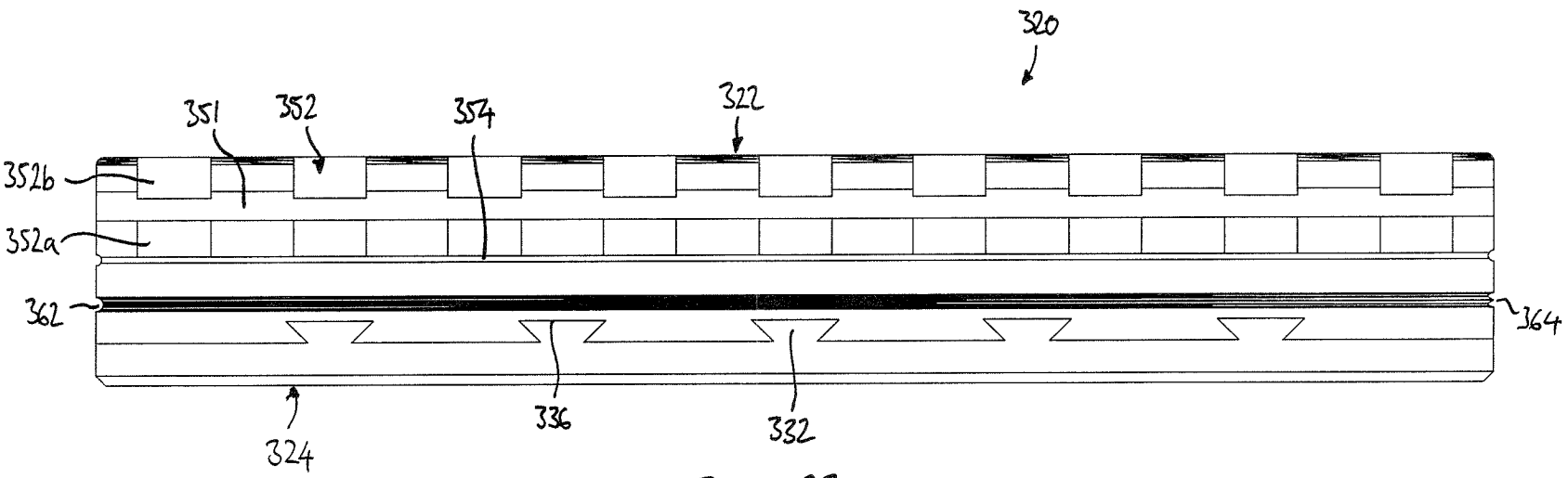
FIG. 23 is a top view of the building block of FIG. 21.
Figure 24:
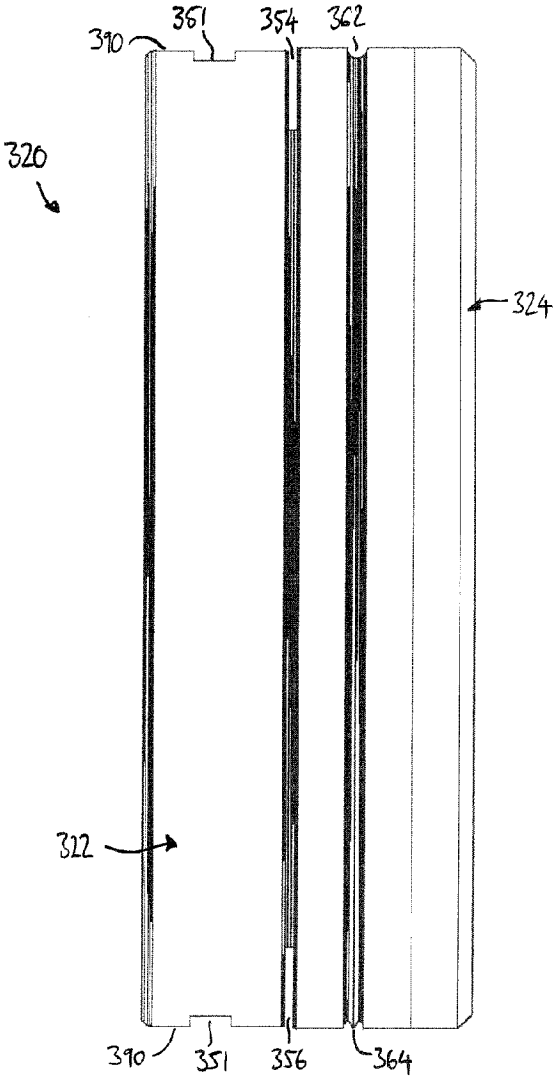
FIG. 24 is a side view of the building block of FIG. 21.

As can be seen most clearly in FIG. 22, in this embodiment, the rear face 350 of the body 322 is substantially planar, without drainage channels. The top face of the body 322 is provided with a plurality of inclined drainage slots or channels 352, which run from the upper bracket-receiving recess 354 to the rear face 350 of the body 322, and get deeper moving towards the rear face 350 of the body 322. The drainage channels 352 intersect the rear face 350 so that the channels 352 act to direct water from the top face of the block 320 to the rear face 350. In this embodiment, excess water can therefore flow down the rear face 350 of the body 322.

A groove 351 extends along the entire length of the top face of the body 322, parallel to the rear face 350. The inclined channels 352 intersect the groove 351, so that one portion 352*a* of each inclined channel 352 directs water into the groove 351, and another portion 352*b* of each channel 352 directs water from the groove 351 towards the rear face 350. The groove 351 helps to collect water that passes through the drainage holes in the support brackets.

Figure 25:
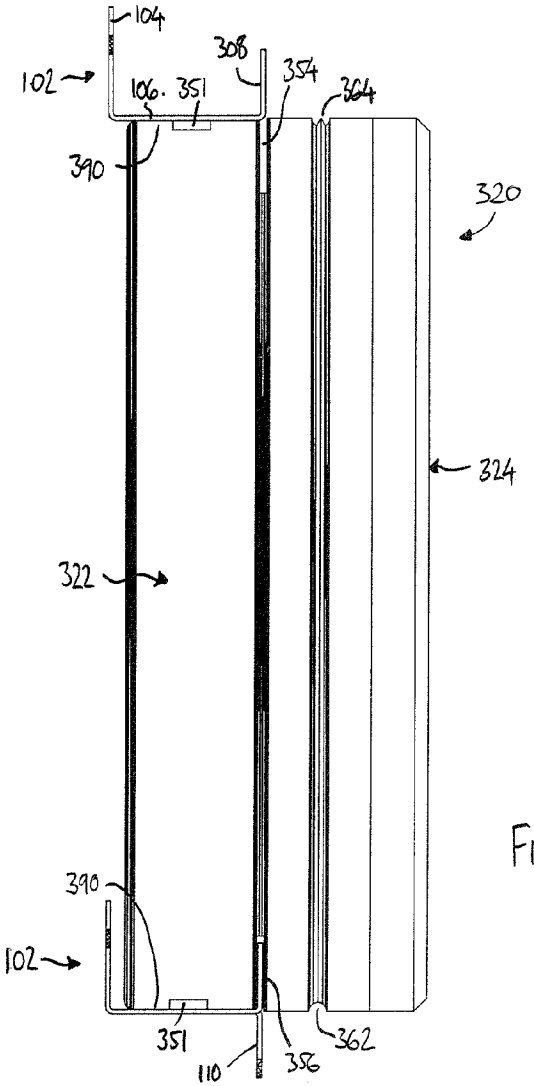
FIG. 25 is a side view of a block of the type shown in FIGS. 21 to 24 in use in a cladding system, and a plurality of support brackets.

FIG. 25 show the block 320 of FIGS. 21 to 24 mounted in a cladding system by two support brackets 102 of the type described with reference to FIG. 14. The upper bracket-receiving recess 354 receives the downwardly-extending fingers 110 of the bracket 102 positioned above the block 320, and the lower bracket-receiving recess 356 receives the upwardly-extending fingers 108 of the bracket 102 positioned below the block 320.

As in the previously-described embodiment, the body 322 is shaped so as to accommodate the base members 106 of the support brackets 102 in order that portions of the top and bottom faces of bodies of neighbouring blocks in adjacent horizontal rows can abut one another. However, in this case, both the top face and the bottom face of each body 322 includes a cutaway 390 having a depth that is approximately half of the thickness of the base member 106 of a support bracket 102.

In this way, the base member 106 is accommodated between the bodies of neighbouring blocks in adjacent horizontal rows, in part in the cutaway 390 in the bottom face of the body 322 of the block 320 above the support bracket 102, and in part in the cutaway 390 in the top face of the body 322 of the block 320 below the support bracket 102.

Advantageously, the top and bottom faces of the block 320 of FIGS. 21 to 24 are identical. In particular, both faces include cutaways 390, inclined drainage channels 352, and grooves 351. This arrangement allows the blocks 320 to be installed either way up, which simplifies construction. It will be appreciated that the drainage channels 352 in the bottom face are not functional when the block 320 is in use in a cladding system.

Figure 26:
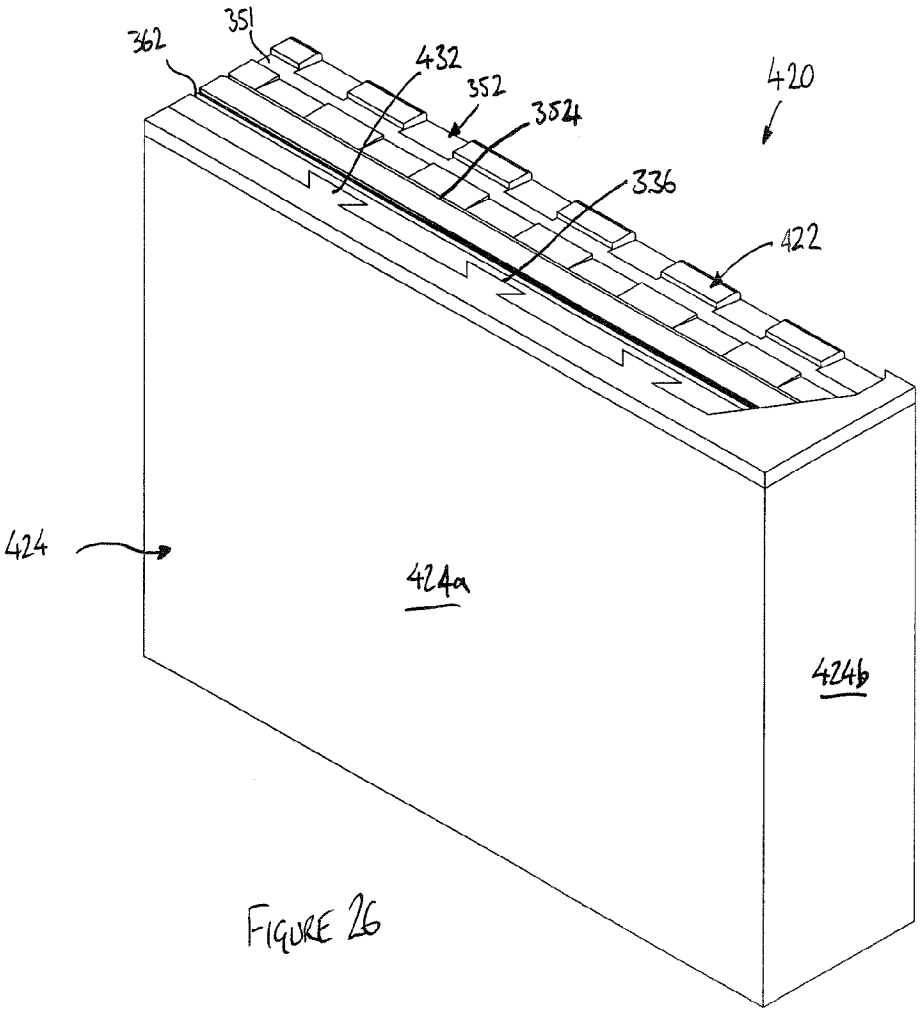
FIG. 26 is a perspective view, from the front, of a variant of the building block of FIG. 21.
Figure 27:
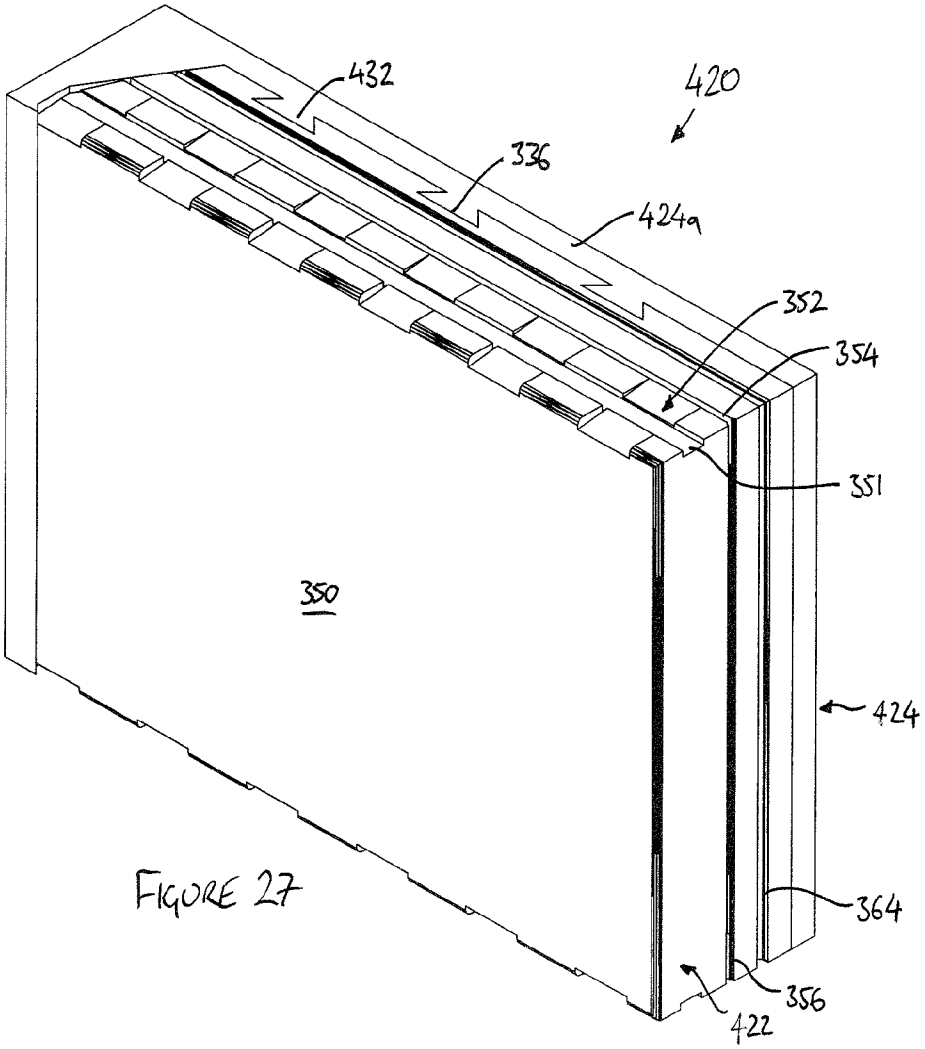
FIG. 27 is a perspective view, from the rear, of the building block of FIG. 26.
Figure 28:
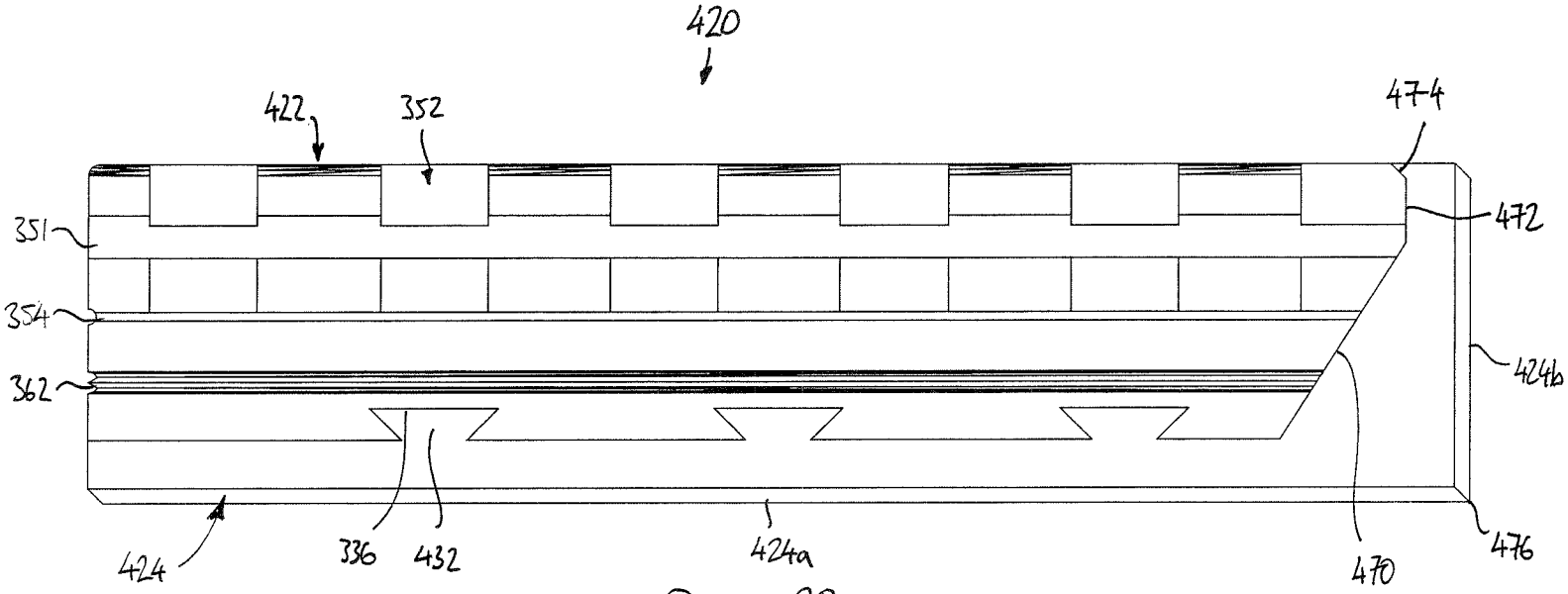
FIG. 28 is a top view of the building block of FIG. 26.

FIGS. 26 to 28 show a variant of the building block of FIGS. 21 to 24, suitable for use as a corner block in a cladding system. The corner block 420 includes a body 422 having the same features as the body 322 of the block of FIGS. 21 to 24, as indicated by use of like reference numerals.

The facing 424 of the corner block 420 extends over the front face of the body 422 and around one of the side faces of the body 420. Therefore the facing 424 incorporates a front face portion 424*a* and a side face portion 424*b*. The end of the body 422 over which the side face portion 424*b* extends is shaped to include an inclined face portion 470 and a narrow end face portion 472. The back corner of the body 422, between the end face 472 and the rear face of the body 422, is also shaped to include an overhand or chamfer 474. Conveniently, when the body 422 is made from expanded polystyrene or a similar material, the end of the body can be hot wire-cut to form the desired shape 470, 472, 474.

The front face portion 424*a* of the facing 424 is engaged with the body 422 by way of projections 432 on the facing 424 and corresponding recesses 336 as previously described. The side face portion 424*b* covers the inclined face portion 470 and the narrow end face portion 472, and engages with the chamfer 474. In this way, the facing 424 and the body 422 are held securely together.

The front and side face portions 424*a*, 424*b* meet at an external corner 476 of the facing 424. Because the inclined face portion 470 of the body 422 is set back from the corner 476, the thickness of the facing 424 at the corner 476 is substantially thicker than elsewhere. This provides increased resistance to damage of the facing 424 at the corner 476 where it is particularly vulnerable to impact and other damage.

In use in a cladding system to clad around corner of a supporting wall, the corner block 420 can be used in a similar manner as described with reference to FIGS. 18 and 19. However, in this case, it is not necessary to cut any of the blocks on-site. Instead, the corner block 420 can be placed overhanging the corner of the supporting wall, and a block 320 of the type shown in FIGS. 21 to 24 can be placed with one of its side faces in abutment with the back face of the overhanging portion of the corner block 420 to complete the cladding without interruption of the insulation provided by the block bodies 322, 422. The corner blocks 420 can also be used to terminate the cladding in an attractive way, such as at window and door openings.

The dimensions of the corner block 420 are selected appropriately for the cladding system. For example, when the non-corner blocks 320 of the cladding system are 600 mm in length and 100 mm in thickness, a convenient size for the corner blocks 420 is 400 mm in length and 100 mm in thickness.

Another embodiment of the invention will now be described with reference to FIGS. 29 to 32. The cladding system of this embodiment, and the corresponding building block, is similar to the cladding system and building blocks of the other embodiments of the invention, and accordingly, only the differences will be described in detail.

As in the previously-described embodiments of the invention, the cladding system includes blocks 520 comprising a body 522 and a facing 524. The facing 524 is engaged with to the body 522 by way of cooperating projections 540 of the facing 524 and recesses 536 in the body 522, as previously described with reference to FIGS. 1 to 4. The body 522 is provided with upper and lower bracket-receiving recesses 554, 556 that cooperate with support brackets when the building block 520 is used in a cladding system, as previously described. Furthermore, as for the block of FIGS. 1 to 4, the body 522 is provided with grooves 562, 564 on the top, bottom and side faces thereof for receiving a bead of sealing material.

In this embodiment, the bracket-receiving recesses 554, 556 and the grooves 562, 564 on the side faces of the block 520 are inclined relative to the plane of the facing 524. Specifically, each of the bracket-receiving recesses 554, 556 and the grooves 562, 564 on the side faces of the block 520 are closer to the facing 524 at the top of the block 520 than at the bottom of the block 520. Additionally, the upper bracket-receiving recess 554 is closer to the facing 524 than the lower bracket-receiving recess 556.

The body 522 of the block 520 is shaped so that, between the grooves 562, 564 and the front face 534 of the body 520 (to which the facing 524 is attached), the top and bottom faces of the body 522 are perpendicular to the plane of the facing 524. Between the grooves 562, 564 and the rear face of the body 520, the top and bottom faces of the body 520 are slightly inclined so as to lie in a plane that is at a small angle to the direction perpendicular to the facing 524. The angle is such that the top edge of the rear face of the body 520 lies above the top edge of the facing 524.

In this embodiment, the facing 524 is greater in height than the body 522. In particular, a bottom end portion 524*a* of the facing 524 extends beyond the bottom face of the body 522.

The rearmost edge of the bottom end portion 524*a* of the facing 524 is radiused to define a curved edge 524*b* of the facing 524.

As in the block shown in FIGS. 1 to 4, the top face of the body 520 includes a gutter 552 for drainage of water, and the bottom face includes a cutaway 590. The gutter 552 and the cutaway 590 are similarly inclined with respect to the direction perpendicular to the facing 524.

Figure 29:
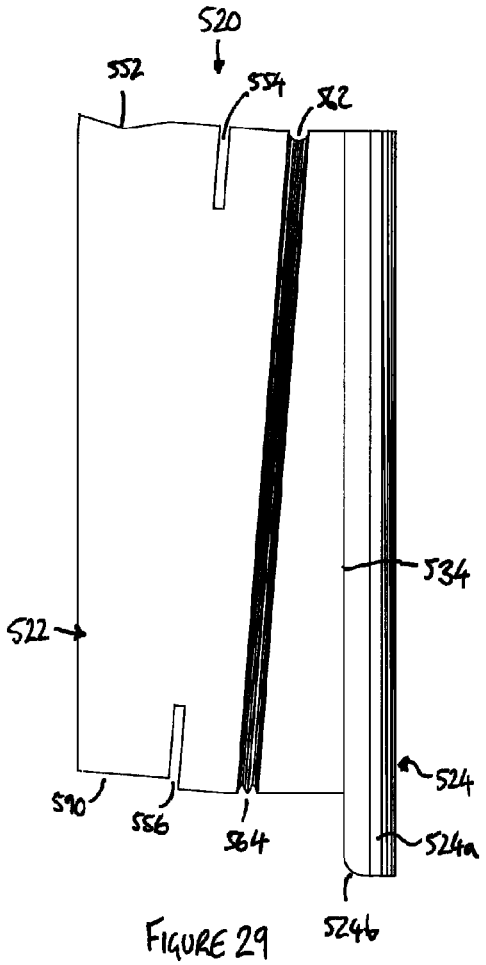
FIG. 29 is a side view of a building block according to another embodiment of the invention.
Figure 30:
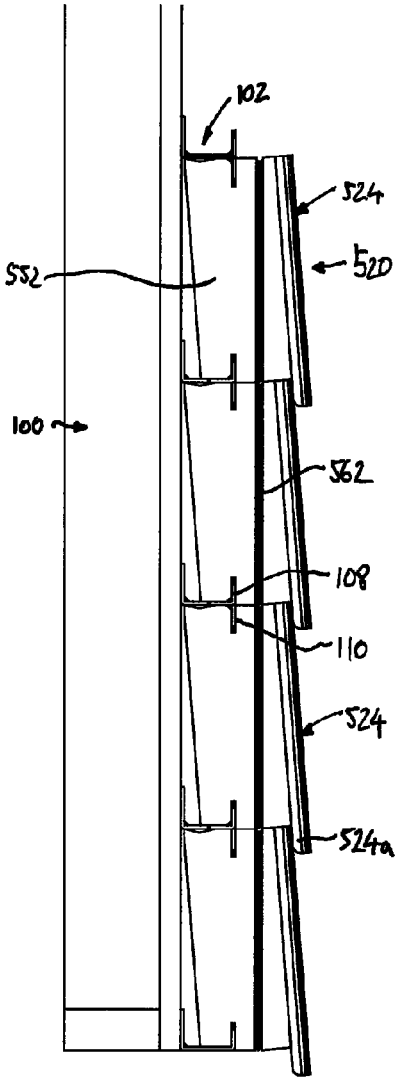
FIG. 30 is a side view of a wall that has been partially clad using a cladding system comprising a plurality of building blocks of the type shown in FIG. 29, and a plurality of support brackets.

FIG. 30 shows a cladding system that includes blocks 520 of the type shown in FIG. 29. The blocks 520 are supported on an inner wall 100 by a plurality of support brackets 102 of the type described with reference to FIGS. 13 to 16.

The upper and lower bracket-receiving recesses 554, 556 of the blocks 520 receive, respectively, the downwardly-extending and upwardly-extending fingers 110, 108 of the brackets 102. Because the top and bottom faces of the block are inclined, and because of the inclined and offset arrangement of the bracket-receiving recesses 554, 556, each block 520 is supported on the wall 100 at an inclined angle.

As a consequence of this arrangement, when the blocks 520 are mounted as shown in FIG. 30. the bottom end portion 524*a* of the facing 524 of each block overlaps the top edge of the facing 524 of the adjacent block in the row below. This overlap gives an aesthetically pleasing effect, and also impedes further the ingress of water and air through the cladding system between neighbouring blocks 520 in adjacent rows.

The angle of inclination of the top and bottom faces of the body 522 of each block 520, and the cutaway 590, are such that the bodies 522 of adjacent blocks 520 abut one another in a face-to-face configuration. In this way, the advantageous thermal insulating and weather resisting properties of the cladding system that arise from the abutting bodies 522 of the blocks 520 are present in this embodiment of the invention, as in the other embodiments of the invention.

The angle of inclination of the grooves 562, 564 in the side faces of the blocks 520 is such that, when mounted as shown in FIG. 30, the grooves 562, 564 in the side faces of the blocks 520 extend vertically, parallel to the supporting wall 100. In this way, the grooves 562, 564 in the top and bottom faces of each block 520 line up with the corresponding grooves in the adjacent blocks 520 in neighbouring rows so as to define a cavity for sealing material, as described above with reference to FIG. 17.

Figure 31:
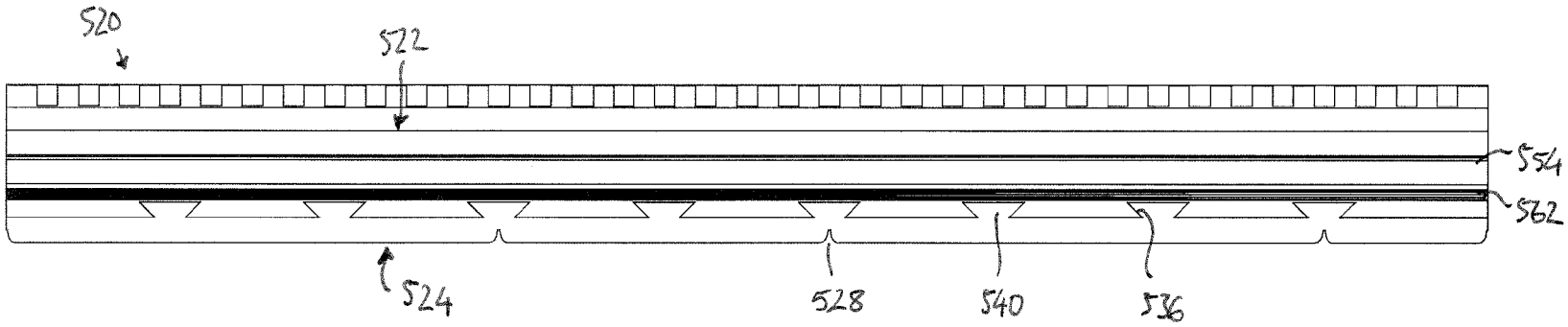
FIG. 31 is a top view of the building block of FIG. 29.

FIG. 31 shows a top view of the block 520 of FIG. 29. Compared to the block 20 shown in FIG. 3, the block 520 of this embodiment of the invention is wider. To give the blocks 520 an attractive appearance, randomly-spaced, vertically-extending lines or grooves 528 are provided in the front face of the facing 524.

The grooves 528 extend part-way through the thickness of the facing 524. To avoid introducing undesirable weaknesses in the cementitious or similar material of the facing 524, each of the grooves 528 is positioned opposite one of the projections 540 on the rear face of the facing 524. Because the material of the facing 524 is thicker in these regions, the presence of the grooves 528 does not unduly affect the mechanical stability of the facing 524.

Figure 32:
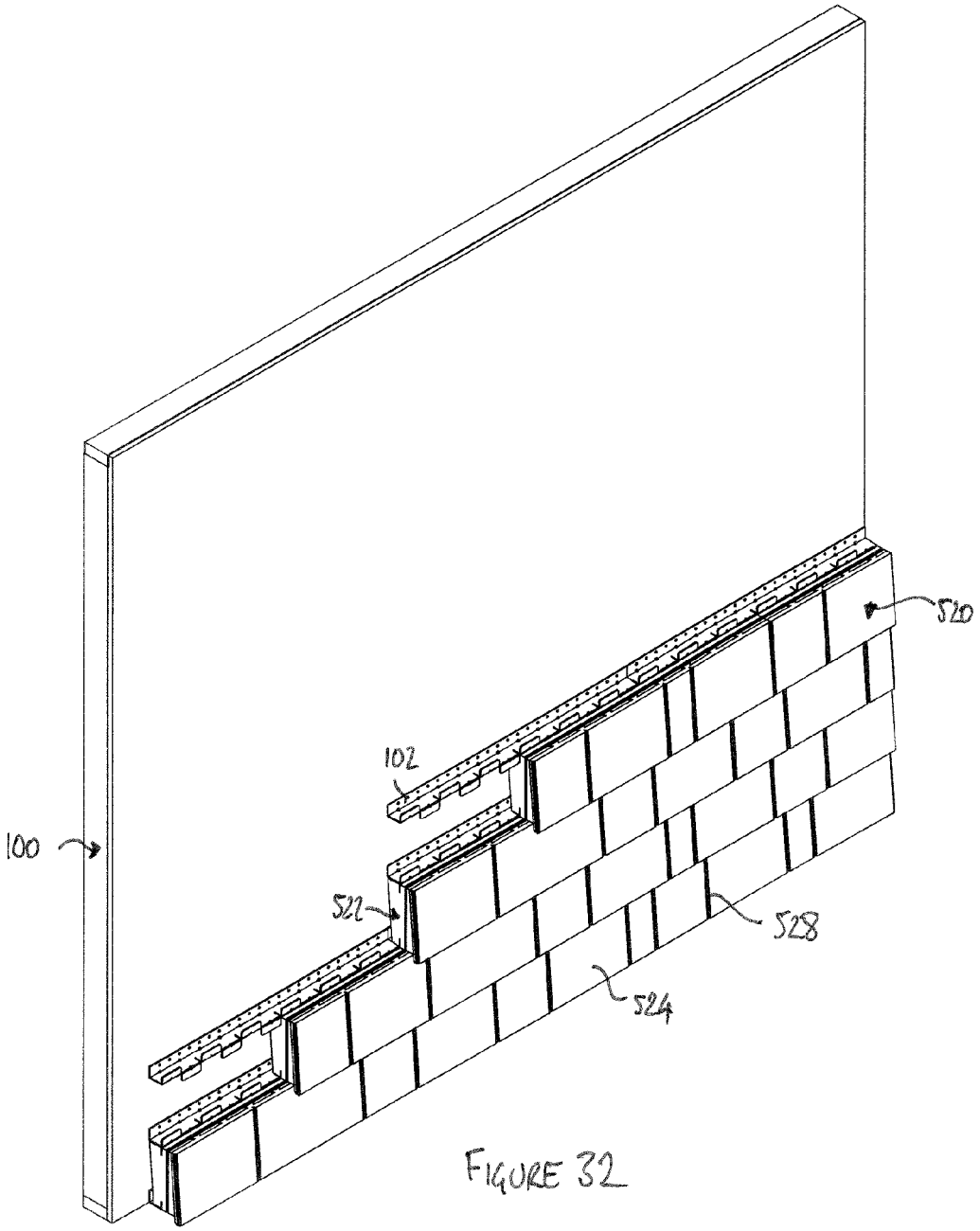
FIG. 32 is a perspective view of the partially clad wall of FIG. 30.

The appearance of the cladding system formed from the blocks 520 is shown in FIG. 32. The vertical grooves 528 in the facing 524 of each block 520 create the impression that the wall has been clad with units of a plurality of different widths, for example of a natural material, even though the blocks 520 are of uniform width. This effect, together with the overlapping facings 524 of the blocks 520 in neighbouring rows, gives the cladding an appearance similar to that of random wood shake siding or slates. If desired, the facings 524 of the blocks 520 can be textured or patterned to give a wood-grain or other decorative effect.

As in the previous embodiments of the invention, the facings 524 of neighbouring blocks in adjoining rows are not in load-transferring contact. Therefore the facings 524 need not be designed to support the weight of facings 524 of the blocks above. Instead, the weight of each facing 524 is borne by the body 522 of the corresponding block, and the weight of each block 522 is borne substantially entirely by the supporting supporting brackets 102 and hence the supporting wall 100.

Figure 33:
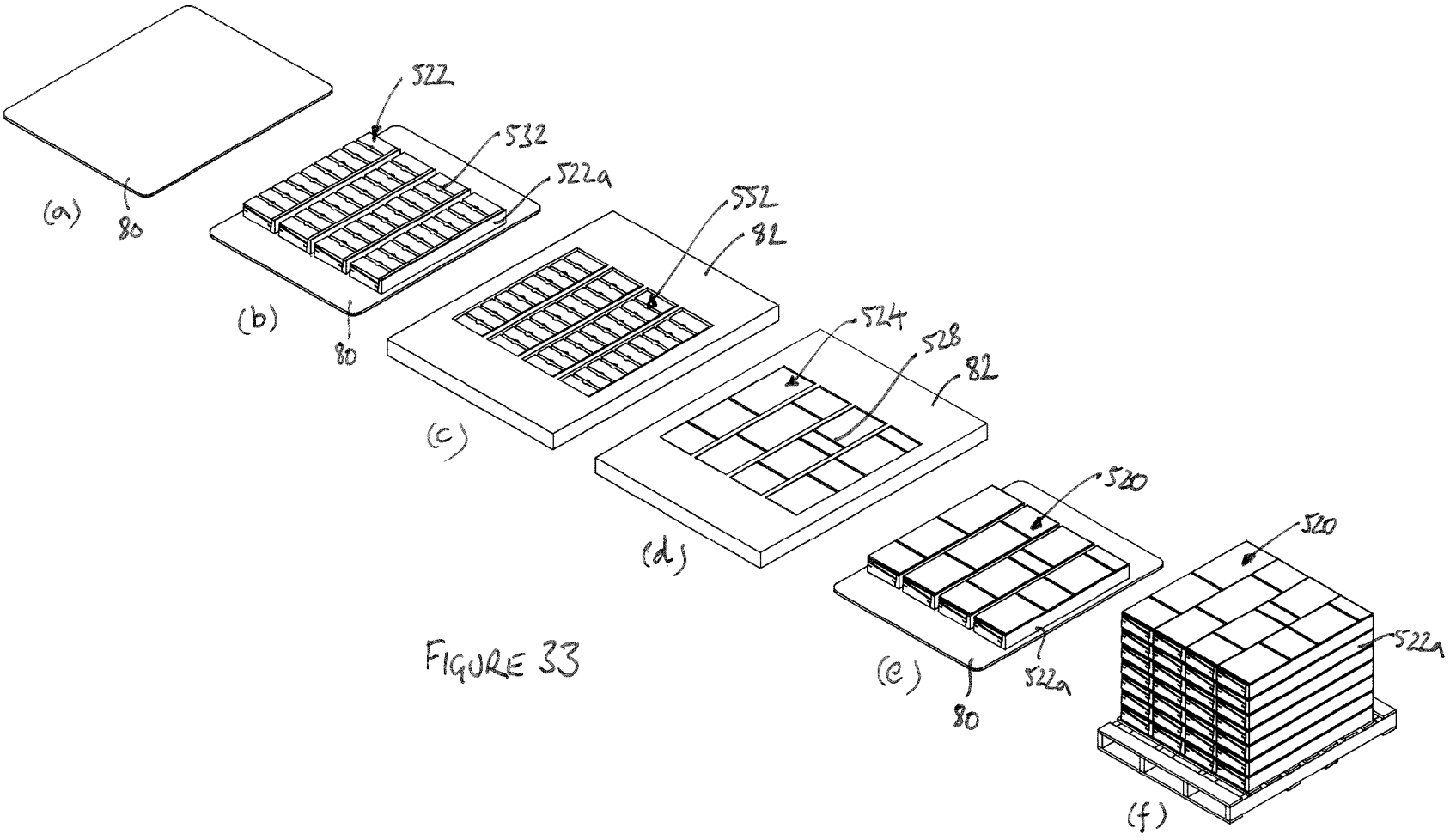
FIG. 33 shows, schematically and in perspective view, a sequence of steps in the manufacture of a plurality of building blocks of the type shown in FIGS. 29 to 32.

FIG. 33 shows, schematically, a sequence of steps in a method of manufacturing a block 520 of the type shown in FIGS. 29 to 32. The method is similar to that described in FIG. 8, and only the details will be described in detail.

Starting with an empty pallet 80 (FIG. 8(*a*)), a plurality of block bodies 522 are arranged on the pallet 80 (FIG. 8(*b*)) so that the recesses 532 are uppermost. The block bodies 522 include a sacrificial portion 522*a*, which can be seen in FIG. 34.

Figure 34:
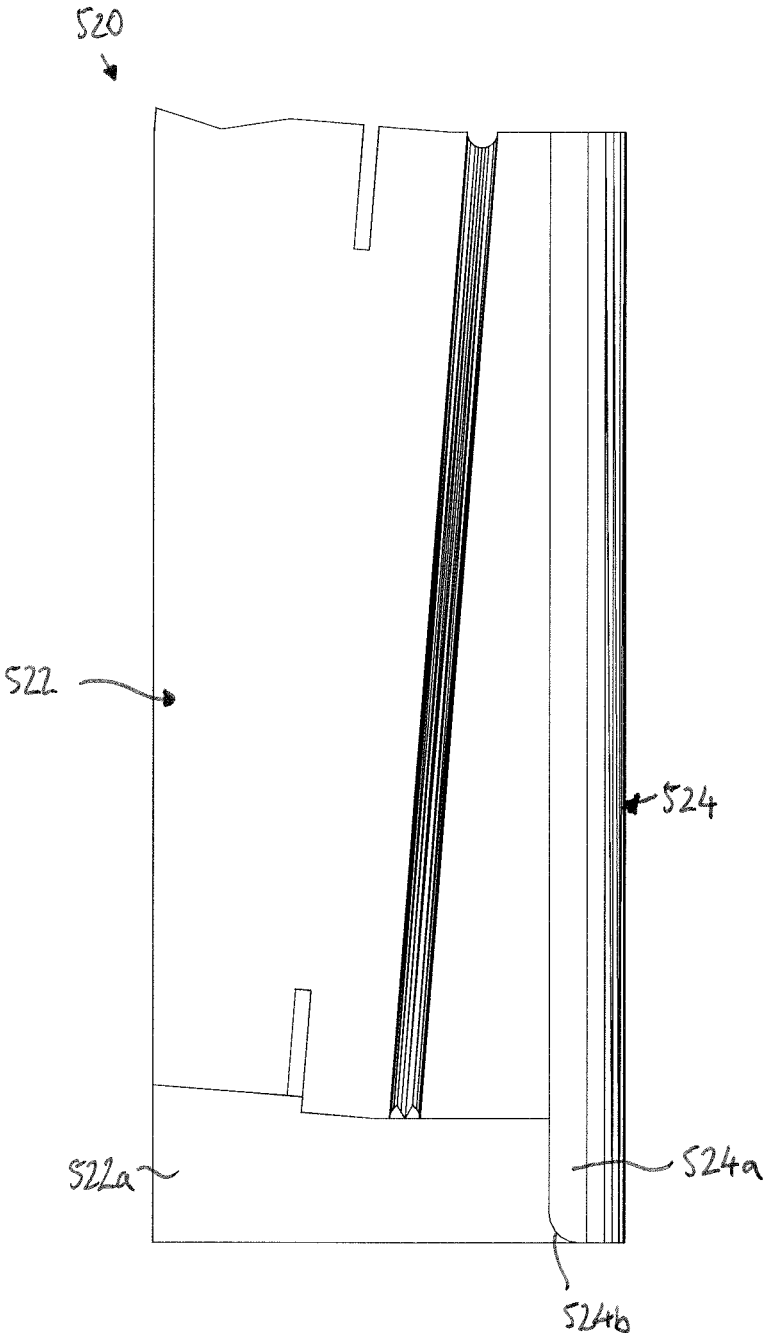
FIG. 34 is a side view of a building block of the type shown in FIGS. 29 to 32 in an intermediate stage of manufacture.

FIG. 34 is a side view of a block 520 in an intermediate stage of manufacture, in which the sacrificial portion 522*a* of the block body 522 is still attached to the body 522. The sacrificial portion 522*a* extends to the bottom edge of the facing 524, so as to support the bottom end portion 524*a* of the facing 524 during manufacture as will be described below.

Returning to FIG. 33, a mould frame 82 is placed around the bodies 522 (FIG. 33(*c*)). The facing 524 of the block is formed by pouring a settable material, such as a wet cementitious mix, into the mould frame 82 (FIG. 33(*d*)). The cementitious mixture is compacted by a mould shoe (not shown) as previously described. By providing suitable relief features on the mould shoe, the vertical grooves 528 and/or other desired decorative elements can be formed in the facings 524.

At this stage, the sacrificial portion 522*a* of the each block body 522 supports the bottom end portion 524*a* of the facing 524. The sacrificial portion 522*a* is also shaped to form the radiused edge 524*b* of the bottom end portion 524*a* (see FIG. 34), or an alternative bottom edge profile if desired. The sacrificial portion 522*a* is preferably coated with a release agent or anti-stick treatment to prevent the material of the facing 524 from sticking to the sacrificial portion 522*a*. This allows easy removal of the sacrificial portion 522*a* at a later stage. The sacrificial portion 522*a* is conveniently formed separately from the remaining portion of the body 522, and the two portions of the body 522, 522*a* are lightly glued or otherwise attached to one another before the bodies are placed on the pallet 80.

As shown in FIG. 33(*e*), the mould frame 82 is removed from the pallet 80, to leave blocks 520 with the sacrificial portion 522*a* of each body 522 still present. Conveniently, the sacrificial portion 522*a* can be left in place during storage and transportation, to protect the bottom edge portion 524*a* of the facing 524 from damage and to aid stacking and handling of the blocks 520. Accordingly, the blocks 520 are removed from the pallet, with the sacrificial portions 522*a* attached, and stacked as shown in FIG. 8(*f*) for storage and transportation.

The sacrificial portion 522*a* of the body 522 of each block can be removed on-site before the block 520 is used. In this way, the sacrificial portion 522*a* remains present for as long as possible to protect the bottom edge portion 524*a* of the facing.

Several variations and modifications of the exemplary embodiments described above lie within the scope of the present invention as defined by the appended claims.

For example, the body of the block may be provided with projections for engagement with recesses in the facing. The facing need not be cast onto the body during manufacturing of the block but, with an appropriate configuration of recesses and projections, the facing could be manufactured as a separate component from the body and subsequently attached to the body to form the block.

The building blocks and other components can have any reasonable dimensions. For example, for typical construction applications, the blocks may be 600 mm in width and 300 or 450 mm in height. In such cases, the facing has a thickness of approximately 20 mm, although a thicker or thinner facing could be provided. In most cases, however, the minimum thickness of the facing is around 10 mm.

For given facing and body materials, the overall thickness of the block determines the degree of thermal insulation provided by the block. Typically, the overall thickness of a block is in a range from about 100 mm to about 240 mm, but thinner or thicker blocks could be provided.

When the blocks are to be manually handled, it is preferable that the overall mass of each block is less than 20 kg, this being the accepted maximum mass suitable for single-person handling in the construction industry. The use of a lightweight body material helps to achieve this target, whilst allowing the block to be relatively large to enable rapid construction using the blocks.

The materials described above are not limiting. For example, as an alternative to expanded polystyrene, the body of the block may instead be made from phenolic resin or polyurethane. Indeed, the body of the block may be made from substantially any building material, and while it is advantageous in some applications for the body of the block to be lightweight and highly thermally insulating, these properties are not always essential.

Thus the body of the block could conceivably be made from concrete, stone, breeze block, or any other reasonable material.

When the body of the block is made from expanded polystyrene, as is preferred, the density of the expanded polystyrene can be chosen so as to optimise the properties of the block. Preferably, the density of the expanded polystyrene has a value in the range from about 16 kg $m^{-3}$ to about 64 kg $m^{-3}$, and more preferably the density of the expanded polystyrene has a value in the range from about 24 kg $m^{-3}$ to about 40 kg $m^{-3}$. It will be appreciated that, as the density of the material increases, its mechanical properties, such as shear strength, compressive stress resistance and tensile strength, improve. Therefore, the choice of density depends on the mechanical and thermal properties required for a particular application.

The body material may be chosen to have good fire resistance. For example, when the body material is expanded polystyrene, a flame-retardant additive such as hexabromocyclododecane may be used to improve the fire resistance of the block.

Likewise, the facing of the block need not be made from a cementitious material. In embodiments of the invention which require the facing material to be settable, the facing could instead be made from a plastics melt or a curable resin material, providing that the facing material is chemically and thermally compatible with the material of the block. When the facing material does not need to be settable, the range of suitable materials extends further.

The density of the facing material affects the overall mass of the block, and also typically influences the mechanical properties of the facing. For example, the density of a typical concrete facing material has a value in the range from about 2000 kg $m^{-3}$ to about 2400 kg $m^{-3}$, but in some applications where the facing need not have a high mechanical strength, a lower-density concrete material could be suitable.

It will also be appreciated that several of the features of the various bodies, building blocks, cladding systems and components thereof described above can be used in isolation from one another or in combinations not explicitly described above. In particular, the interlocking arrangement of the facing and the body, the drainage channels on the rear of the block, the support bracket arrangement of the cladding system and the arrangement of grooves for the sealing material can all be used independently or in any combination in a building block or cladding system.

The invention claimed is:

1. A building block for use in a cladding system for cladding a supporting wall, the cladding system including a plurality of support brackets for mounting a plurality of building blocks on the supporting wall in a plurality of adjoining horizontal rows, the building block comprising:

a facing; and a body which engages the facing, wherein the body comprises:

bracket engaging formations for engaging at least one of the support brackets of the cladding system such that, in use, at least a part of the body abuts at least a part of the body of a neighbouring building block in an adjoining horizontal row so as to guard against water penetration between the rows;

bracket-receiving formations for receiving respective upwardly-projecting and downwardly-projecting elements of the plurality of support brackets of the cladding system which project from a base member of each support bracket; and one or more inclined channels in a top face of the body for directing water toward a rear face of the body.

2. The building block of claim 1, wherein the bracket-receiving formations are recesses in the form of channels extending across the width of the body to allow the block to slide laterally on the support brackets when mounting the building blocks on the supporting wall.

3. The building block of claim 1, including a plurality of drainage channels in the rear face of the body wherein the one or more inclined channels define a gutter in the top face of the body to direct water into the drainage channels.

4. The building block of claim 1, wherein the body is shaped to engage with the facing in such a manner as to guard against relative movement of the facing with respect to the body in any direction.

5. The building block of claim 4, wherein the engagement of the body with the facing incorporates engagement surfaces of the body which engage with the complementary engagement surfaces of the facing.

6. the building block of claim 5, wherein the engagement surfaces of the body are oriented with respect to a front face of the body in such a manner as to form an interlock with the engagement surfaces of the facing in order to guard against relative movement of the facing with respect to the body.

7. The building block of claim 5, wherein the engagement surfaces of the body define walls of a recess in a front face of the body and wherein at least one of the side walls is inclined to define an undercut region of the recess.

8. The building block of claim 7, wherein the recess incorporates two opposing side walls which diverge in a direction away from the front face of the body so that the recess incorporates a dovetail mortise.

9. The building block of claim 7, wherein the recess extends linearly across a part of, or the whole of, the front face of the body.

* * * * *